US008672166B2

(12) United States Patent
Nazareth et al.

(10) Patent No.: US 8,672,166 B2
(45) Date of Patent: Mar. 18, 2014

(54) RESEALABLE FOOD CONTAINER WITH LID HAVING A TAMPER EVIDENT TEAR AWAY BAND

(75) Inventors: Darryl Nazareth, Sayreville, NJ (US); Sameh Guirguis, Sayreville, NJ (US); Bernard Ampomah, Sayreville, NJ (US); Yohanan Siskindovich, Sayreville, NJ (US)

(73) Assignee: Sabert Corporation, Sayreville, NJ (US)

( * ) Notice: Subject to any disclaimer, the term of this patent is extended or adjusted under 35 U.S.C. 154(b) by 915 days.

(21) Appl. No.: 12/317,625

(22) Filed: Dec. 24, 2008

(65) Prior Publication Data

US 2010/0155289 A1 Jun. 24, 2010

(51) Int. Cl.
*B65D 17/40* (2006.01)

(52) U.S. Cl.
USPC ..... 220/276; 220/270; 220/793; 215/256

(58) Field of Classification Search
USPC ..... 220/276, 270, 793; 215/256
See application file for complete search history.

(56) References Cited

U.S. PATENT DOCUMENTS

| | | | | |
|---|---|---|---|---|
| 4,103,803 | A * | 8/1978 | Irvine | 220/270 |
| 4,315,791 | A | 2/1982 | Ishii et al. | |
| 4,474,304 | A * | 10/1984 | Jacobs | 220/276 |
| 4,487,329 | A * | 12/1984 | Winstead | 220/276 |
| 4,738,375 | A * | 4/1988 | Rosen et al. | 220/276 |
| 4,798,301 | A * | 1/1989 | Bullock et al. | 215/256 |
| 4,930,656 | A * | 6/1990 | Blanchette | 220/276 |
| 6,499,621 | B1 | 12/2002 | Yamaguchi et al. | |
| 6,604,645 | B1 * | 8/2003 | Vaupotic | 220/212 |
| 2004/0094553 | A1 * | 5/2004 | Crider et al. | 220/276 |
| 2005/0133508 | A1 | 6/2005 | Landis et al. | |
| 2006/0006178 | A1 | 1/2006 | Foldesi et al. | |
| 2006/0175334 | A1 * | 8/2006 | Schwarz | 220/276 |
| 2006/0266750 | A1 * | 11/2006 | Lesquir | 220/276 |
| 2006/0278652 | A1 * | 12/2006 | Vovan et al. | 220/793 |
| 2007/0012710 | A1 * | 1/2007 | Vovan | 220/793 |
| 2008/0035641 | A1 * | 2/2008 | Foldesi et al. | 220/276 |
| 2008/0274313 | A1 * | 11/2008 | Hanten | 428/34.8 |
| 2008/0302798 | A1 | 12/2008 | Foldesi, Sr. | |

FOREIGN PATENT DOCUMENTS

| | | | |
|---|---|---|---|
| WO | WO 2005/056414 | A1 | 6/2005 |
| WO | WO 2008/021262 | A2 | 2/2008 |

* cited by examiner

*Primary Examiner* — J. Gregory Pickett
*Assistant Examiner* — Blaine Neway
(74) *Attorney, Agent, or Firm* — Cozen O'Connor

(57) ABSTRACT

A tamper evident package for food products is provided having a tray and a lid, which may or may not be permanently attached to each other, and includes a plastic tray for receiving a plastic lid for mating the lid and the tray, wherein the plastic lid is integrally formed with a plastic tear away band at the periphery of the lid, and a perforated section on the lid removably connects the lid and the tear away band in order to tear away the band from the lid.

21 Claims, 30 Drawing Sheets

RESEALABLE FOOD CONTAINER WITH LID HAVING A TAMPER EVIDENT TEAR AWAY BAND

FIELD OF THE INVENTION

The present invention relates to a thermoformed tamper evident food container with an integrally formed tear away band on the periphery of the lid to seal the container. The lid also includes an outwardly extending tab in order for the lid to be opened from the container.

BACKGROUND OF THE INVENTION

The use of plastic disposable containers and trays for packaging, distributing, food are widespread in the marketplace. Due to safety concerns, as in the drug and pharmaceutical industries, the use of tamper evident and tamper resistant medicine containers are commonplace. Similarly, the food industry is demanding that food containers also incorporate tamper evident and tamper resistant features.

These tamper evident features typically include structural design elements which, when the container is tampered with or opened, enable the consumer to easily visually recognize such tampering so that the product can be rejected. Besides ensuring product safety, such tamper evident and resistant elements are important for, among other things, deterring theft and preventing the loss of product and income for the seller, as well as inspiring consumer confidence in the integrity of the contents within the container, and confidence in the ability of the seller and/or manufacturer to provide and maintain quality goods and food products.

Currently, tamper evident shrink preforms or shrink bands with vertical or horizontal perforations are widely used to seal the lid on food containers. There are advantages to this method as it provides a visible indicator that the product is tamper proofed, and the tearing of the band indicates that the product has been tampered or opened. However, the use of these bands is quite expensive. Adding the tamper evident shrink preform or band typically includes an extra step and a secondary process requiring heat to be applied to a typically polyvinyl chloride (PVC) band and shrink it to thereby seal the preferred opening of the packaged food item. Although, this sealing method is effective and renders the product tamper evident, the secondary process is expensive as it requires the purchase of the shrink banding equipment, labor and operating costs, and the cost of the PVC shrink perform material. All of these secondary processing steps add to the cost of the food container package itself. A key advantage of these preform shrink bands are that they are ubiquitous in the marketplace, are intuitive and easy for consumers to use.

Furthermore, it is also important to include consumer-preferable design elements, such as lid re-application features that are reliable and easy to operate, along with tamper evident and resistant features that deter tampering, and clearly indicate whether tampering has occurred. They are also reliable without being burdensome to the legitimate consumer.

There is a need to provide the food industry with a re-closeable food container that has a lid with an integrally formed tear away band that serves as the tamper evident feature, thereby eliminating the need for the use of the PVC preform shrink band, and eliminating the operating and labor costs to put this band on the container. Accordingly, the present invention is directed to a food tray container that meets these needs.

DESCRIPTION OF THE PRIOR ART

Tamper Evident Shrink Preforms or Bands with vertical or horizontal perforations are used to seal the food containers and are commonplace throughout retail food stores and food-service establishments to increase consumer confidence in the items for sale. Adding a tamper evident shrink perform or band typically includes an extra step and a secondary process requiring heat to be applied to a polyvinyl chloride (PVC) band sealing the preferred opening of the packaged food item. Although, this sealing method is effective, the secondary process is expensive as it requires companies to purchase the shrink banding equipment, incur labor and operating costs, and the cost of the PVC shrink band material.

Tamper evident containers eliminating the use of shrink bands have been disclosed in the prior art. However, all prior developments utilize other secondary sealing operations, such as radio frequency sealing or welding.

Tamper resistant containers, tamper proof reclosing lids and tamper proof food containers having various designs, configurations, structures and materials of construction have been disclosed in the prior art. For example, U.S. Pat. No. 7,118,003 to SELLARI et al. discloses a tamper-resistant container with a tamper evident feature including a cover portion defining an outwardly extending peripheral flange, a tray portion defining an upper peripheral edge, and a hinge joining the outwardly extending peripheral flange with the tray portion. The upper peripheral edge includes an upwardly projected bead extending substantially about the perimeter of the tray portion that is configured to render the outwardly extending flange of the cover portion relatively inaccessible when the container is closed. The hinge includes a frangible section, which upon serving, provides a projection that extends out beyond the upwardly projecting bead of the upper peripheral edge of the tray portion, for facilitating removal of the cover portion from the tray portion to open the container. The aforementioned upwardly projecting bead prevents unauthorized access to the contents of the container by making it difficult to pull the cover portion from the tray portion. If access to the container is desired, the strip must be removed so that the upper and lower arms are free to be used to leverage the cover portion from tray portion. The cover portion may be replaced on the tray portion after the container is opened. The strip, however, once removed, is not replaceable. Thus, removal of the strip functions as a clear indicator of possible tampering, if the strip is partially or fully removed prior to the purchase, it is readily apparent to a consumer that someone may have already gained access to the contents of the container. This prior art patent does not disclose or teach the structure of the tamper evident food container of the present invention.

U.S. Pat. No. 5,219,087 to CHRISTENSSON discloses a tamper proof-protected reclosing device including a cover frame having a downwardly turned U-shaped groove into which a planar cut upper or lower edge of a container is designed to be pushed and fastened. A cover element is connected to the frame by a hinge and is designed to be pushed into and releasably secured in the interior of the cover frame. When the container is sealed, the cover element is pushed into the cover frame. The tamper proof-protection is designed as a projecting appendage of the cover frame or the cover element, and forms a tear tab attached by a tear weakening. When the reclosing device is not broken, the tear tab locks the cover element and the cover frame against each other. The projecting appendage, when the container is sealed, is folded and sealed in such a way that the cover element cannot be opened up provided the appendage is not torn off from the cover frame and the cover element. The cover element in the device is provided with a projecting gripping tongue in order to make it easier to push the cover upwards out of the frame and with a snapping hook, is designed to releasably lock the cover in the frame. In addition, the tear tab is designed as a projecting element, from an area at or close to the upper edge of the frame and is designed with a centrally disposed slit, which mateably engages with the gripping tongue. This prior art patent does not disclose or teach the structure of the tamper evident food container of the present invention.

European Patent Application No. EP1,736,417 and EP1, 801,026 to VOVAN discloses a tray or container which includes a tray that can hold food and a lid that closes on the tray, which clearly indicates if the lid has been opened after food is placed into the tray and the lid is closed. The tray and lid each have trapping portions and pull-open portions with a tear-tab, or tear open barrier. To close the lid, the user inserts a tab on the pull-open portion of the lid through a slot in the pull-open portion of the tray, and then presses down the entire trapping portion of the tray. The lid cannot be lifted up because the tear-open barrier forming the top wall of the slot lies over the tab. To open the container, a person must tear the barrier so one can pull the tab and open the lid. The fact that the barrier has been torn is obvious. This prior art patent does not disclose or teach the structure of the tamper evident food container of the present invention.

None of the aforementioned prior art patents teach or disclose a tamper evident and tamper resistant food container that has a lid with an integrally formed tear away band at the periphery of the lid to separate the lid from the tray.

Accordingly, it is an object of the present invention to provide a tamper evident food container having a lid with an integrally formed tear away band at the periphery of the lid to separate the lid from the tray.

A further object of the present invention is to provide a tamper evident food container which has a re-closeable lid, and is easy for people to use intuitively without instructions.

A further object of the present invention is to provide a tamper evident food container and lid that can be mass-produced in an automated and economical manner and is readily affordable by the consumer.

SUMMARY OF THE INVENTION

A tamper evident package for food products is provided having a tray and a lid, which may or may not be hingedly attached to each other, and includes a plastic tray for receiving a plastic lid for mating the lid and the tray, wherein the plastic lid is integrally formed with a plastic tear away band at the periphery of the lid, and a perforated section on the periphery of the lid removably connects the lid and the tear away band in order to tear away the band from the lid.

BRIEF DESCRIPTION OF DRAWINGS

Further objects, features and advantages of the present invention will become apparent upon consideration of the following detailed description of the presently preferred embodiment when taken in conjunction with the accompanying drawings, wherein.

DETAILED DESCRIPTION OF THE EMBODIMENTS

First Embodiment 10

Figure 1:
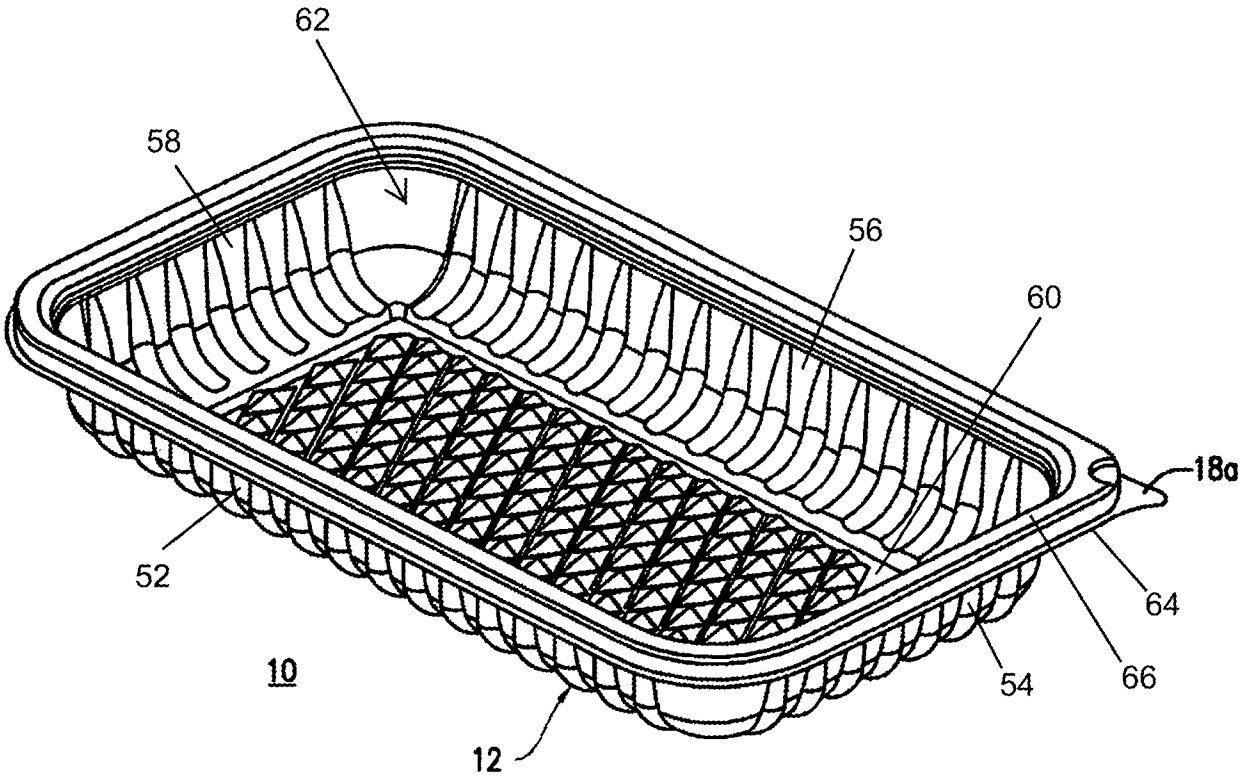
FIG. 1 is a front perspective view of the tray of the tamper evident food container of the preferred embodiment 10 of the present invention.
Figure 2:
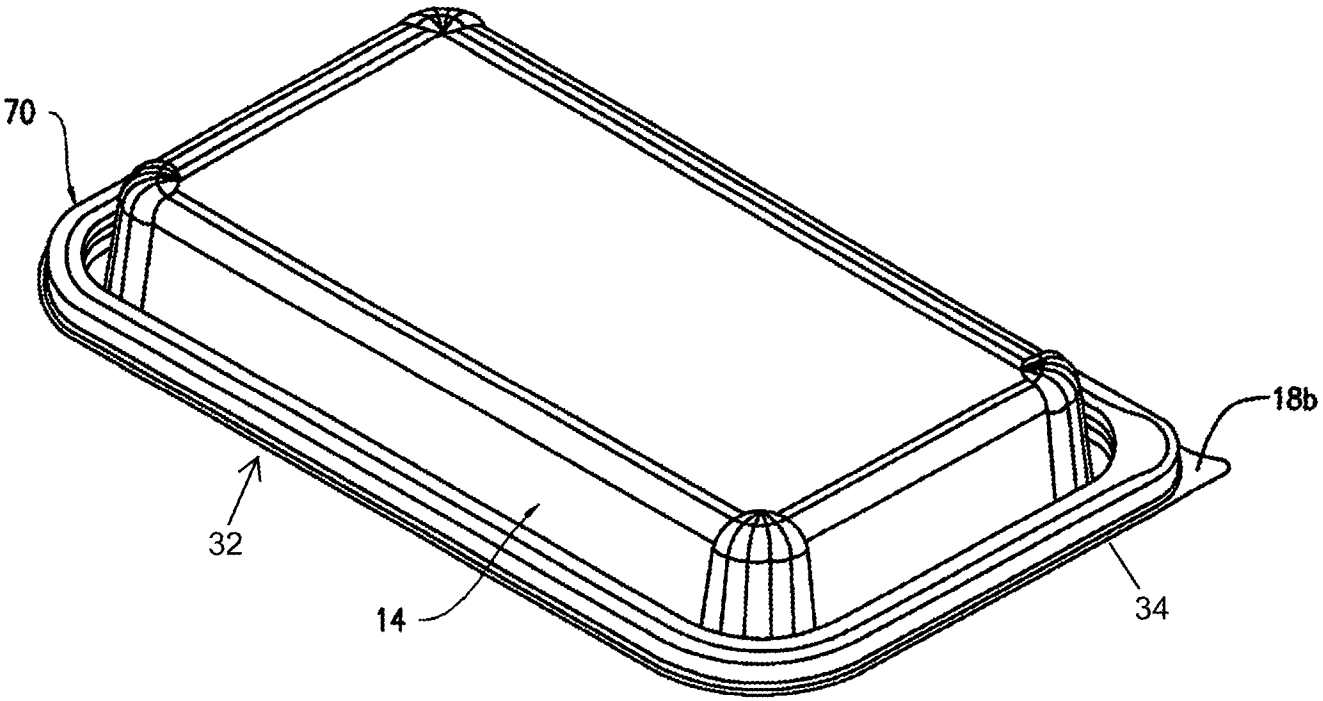
FIG. 2 is a front perspective view of the lid of the tamper evident food container of the preferred embodiment 10 of the present invention.
Figure 3:
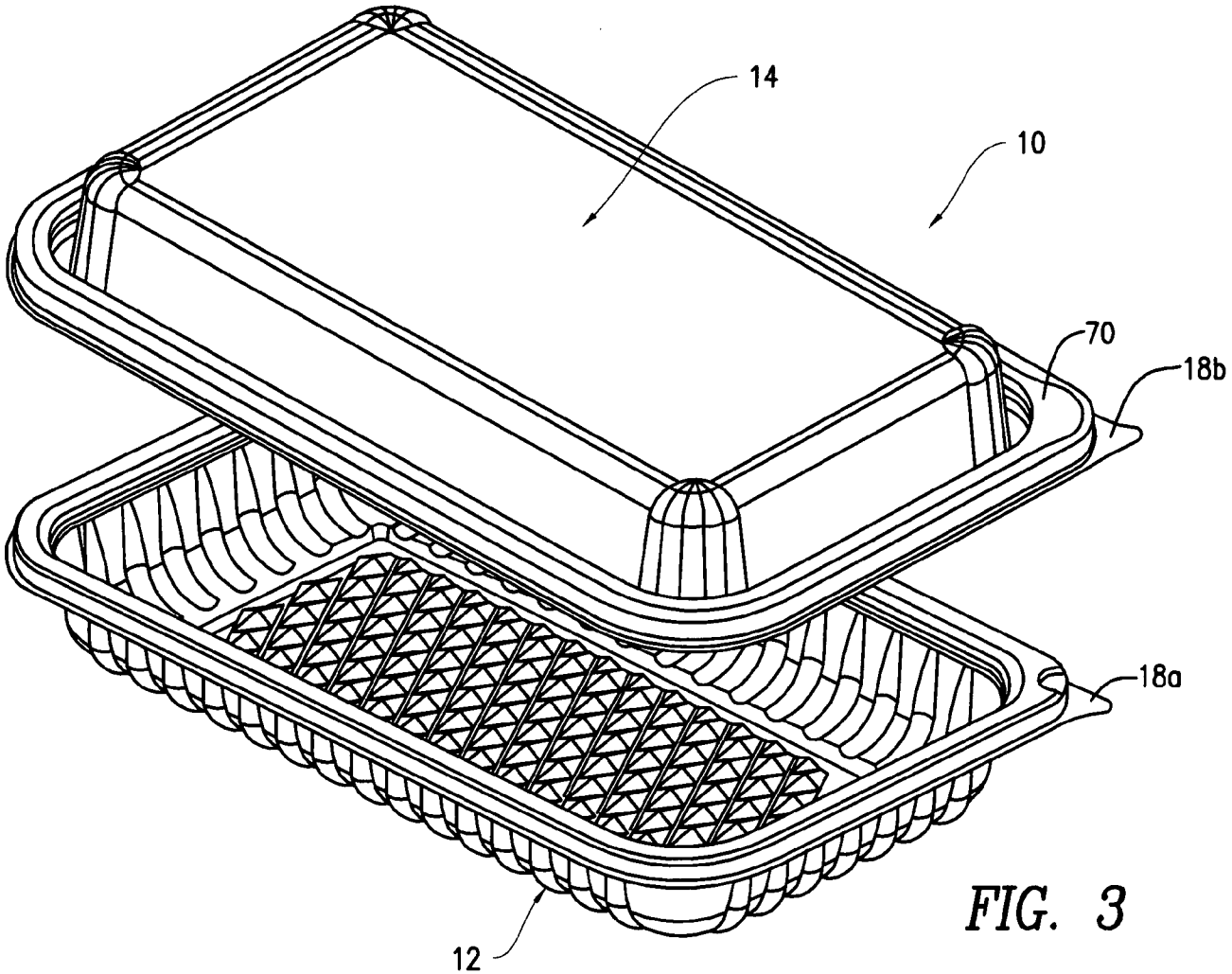
FIG. 3 is a front perspective view of the tray and lid of the tamper evident food container of the preferred embodiment of the present invention.
Figure 4:
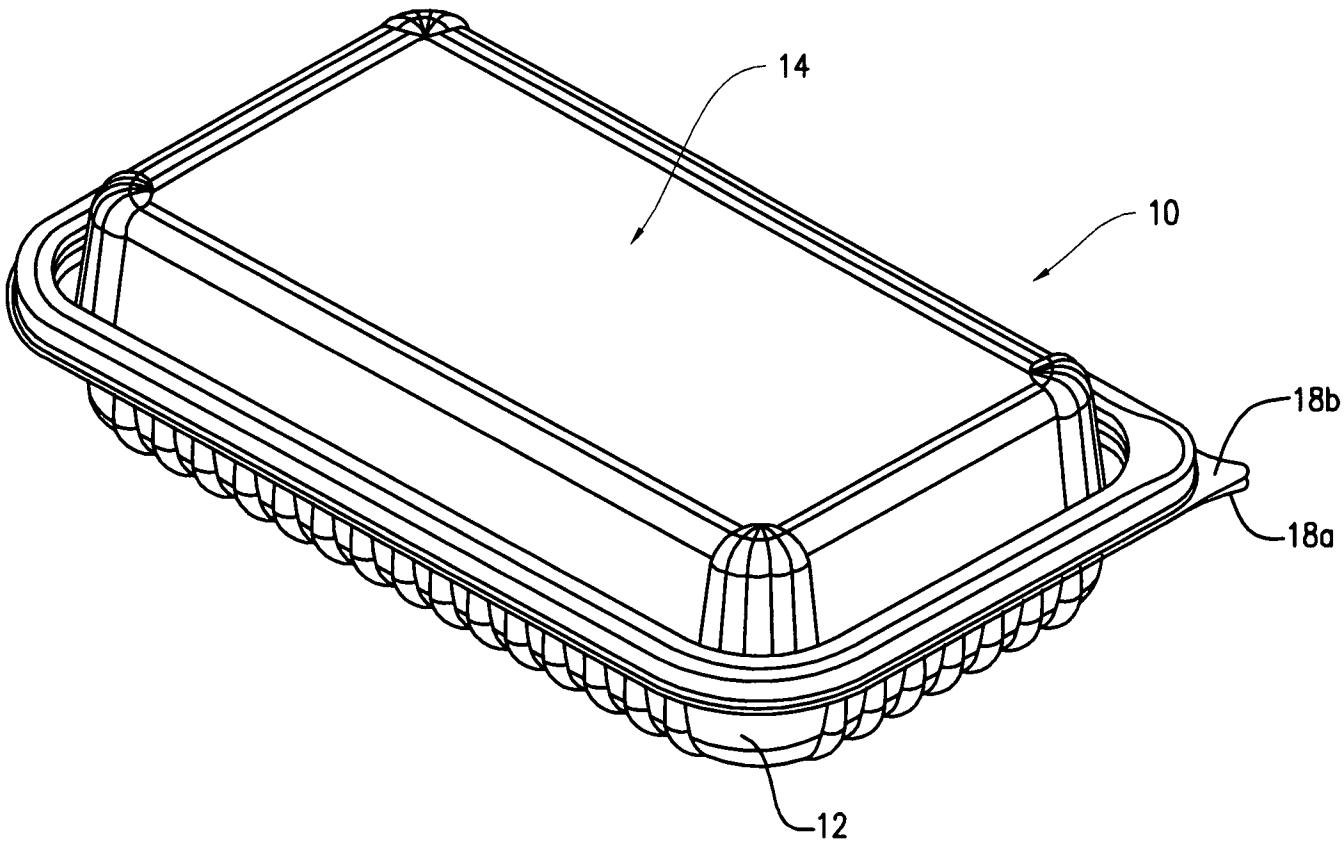
FIG. 4 is a front perspective view of the assembled tray and lid of the tamper evident food container of the preferred embodiment of the present invention.
Figure 5:
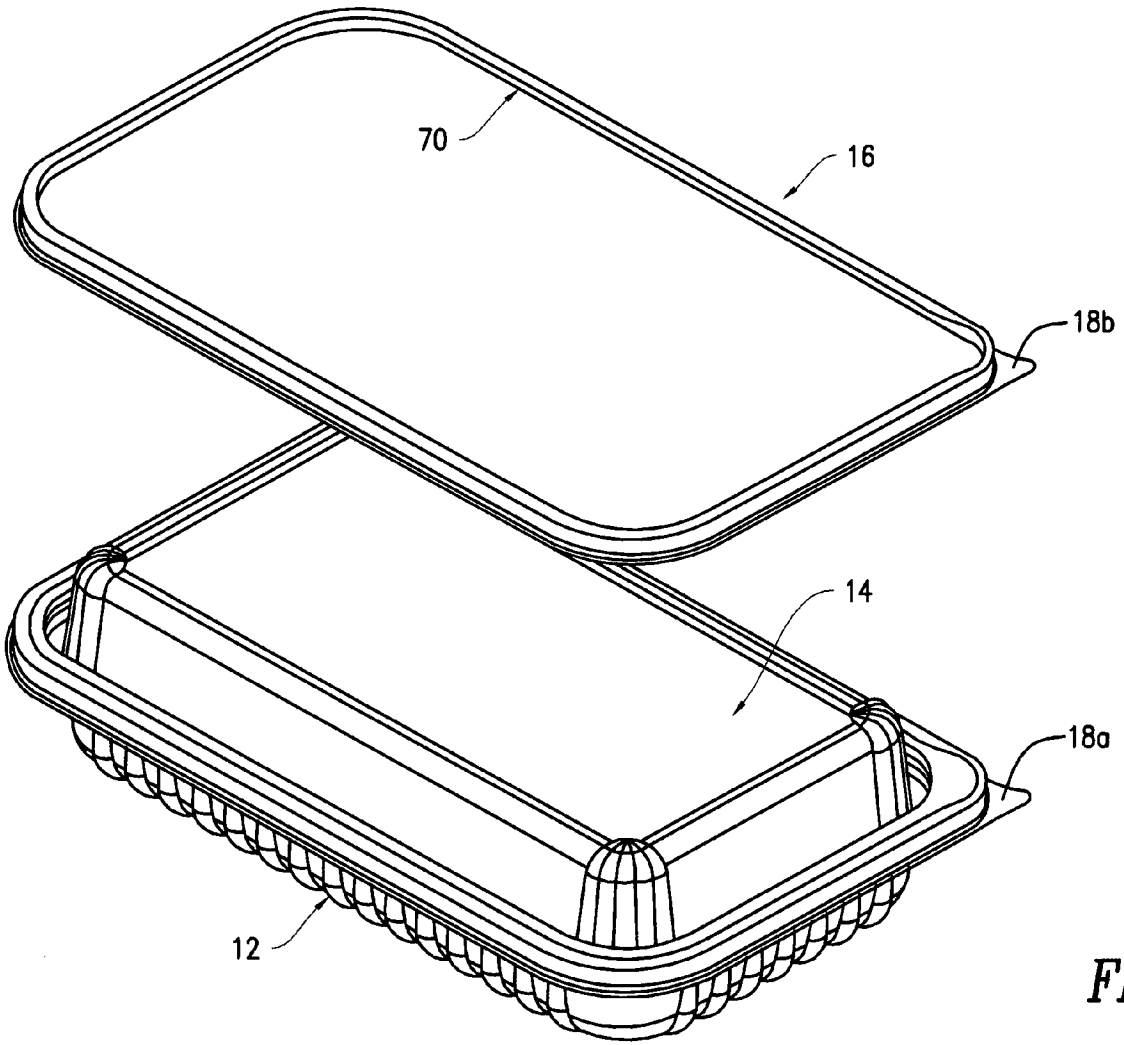
FIG. 5 is a front perspective view of the assembled tray and lid of the tamper evident food container of the preferred embodiment of the present invention, with the tear away band removed.
Figure 6:
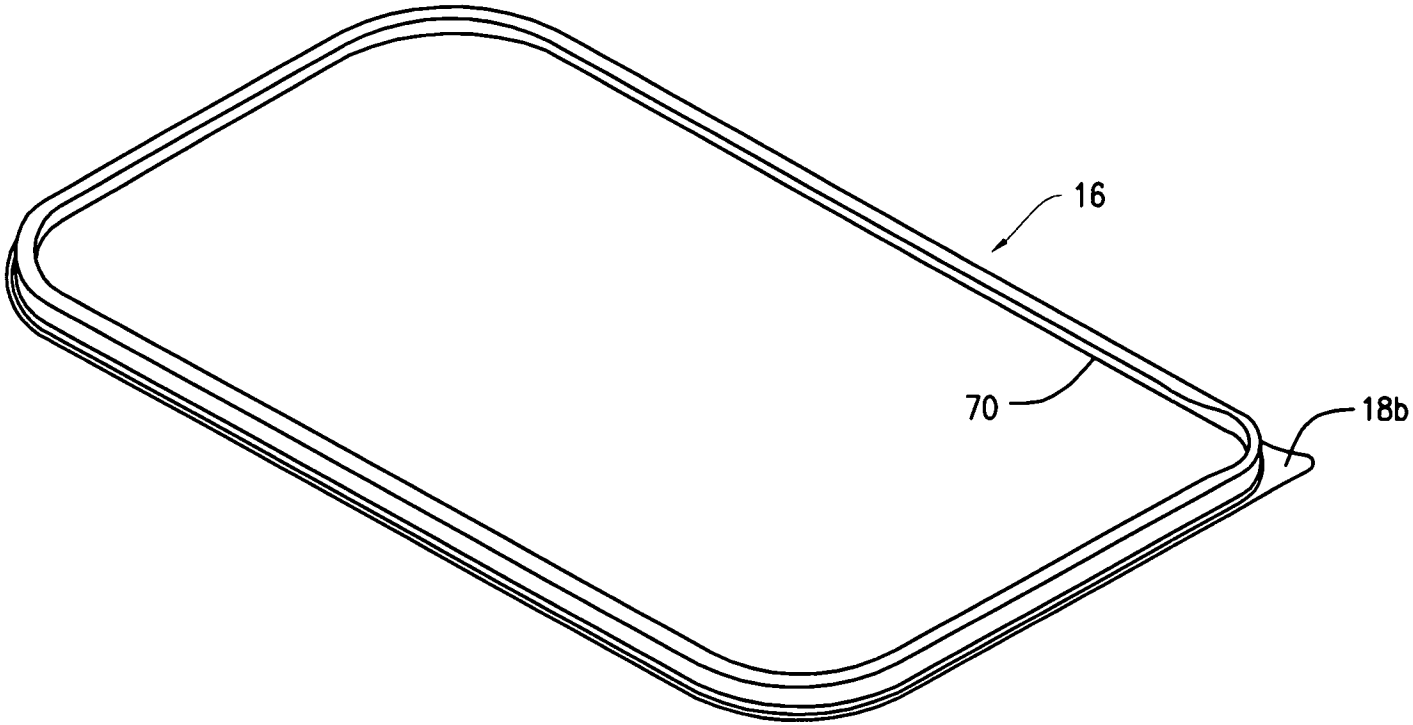
FIG. 6 is a perspective view of the tear away band.

The combined tamper evident food container 10 has a container or base tray 12, a cover lid 14, and a tamper evident removable seal or tear away band 16 on the periphery of the lid 14. The first embodiment 10 of the present invention is represented in detail by FIGS. 1 through 12 of the patent drawings. The combined tamper evident food container 10 is used for holding food product(s) within the tray 12, such that the cover lid 14 is locked in place by the tamper evident removable seal 16, for showing a consumer that the container has not been tampered with and that the securing seal 16 has not been broken. The cover lid 14 is made from transparent plastic materials Pt or non-transparent materials, which in the preferred embodiment is PET. The base tray 12 is made from transparent or non-transparent plastic materials Ps, which in the preferred embodiment is PET. Alternatively, other plastic materials may be used, such as HDPE, PP, PS, and PLA (poly lactic acid), to form the tray 12 and lid 14.

As shown in FIGS. 1 through 12 of the drawings, the base tray 12 includes tray side walls 52, 54, 56 and 58 and a bottom wall 60 for forming an interior base compartment 62. The tray side walls 52 to 58 of the interior base compartment 62 include an upper peripheral edge 64. The upper peripheral edge 64 includes an upper peripheral receiving section 66 being adjacent to the tray side walls 52 to 58 of the base tray 12. Additionally, the upper peripheral receiving section 66 on the interior compartment 62 of the tray 12 is for detachably receiving the perimeter lid edge 34 of the lid interior compartment 32 of the cover lid 14, for locking the cover lid 14 to the tray 12, forming a locking area 80.

The plastic lid 14 is thermoformed with an integrally formed plastic tear away band or seal 16 at the periphery of the lid 14 along a perforation line 70 which is formed in the top of band 16. The perforation line 70 removably connects the lid 14 and the tear away band or seal 16, so that the user can tear away the seal or band 16 from the periphery of the lid 14, and unseal the container 10. The tray 12 includes a corner tab 18*a*, and the lid 14 also includes an opening tab 18*b* in order to lift up lid 14 and remove it from tray 12.

Figure 11A:
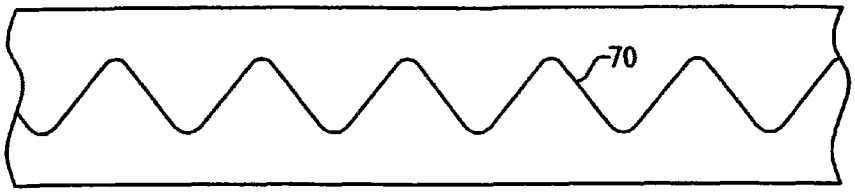
FIGS. 11 and 12 show different perforated lines and perforated sections, such as a wave-form, zig-zag, saw-tooth, or a straight line.
Figure 11B:
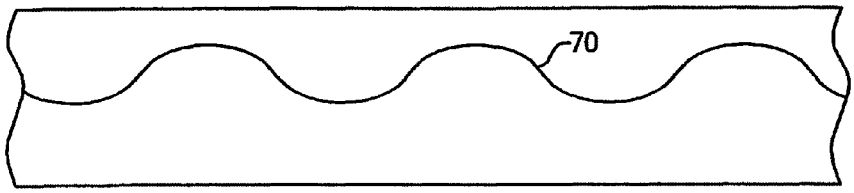
Figure 11C:
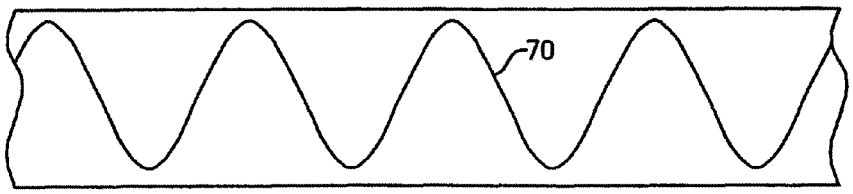
Figure 12:
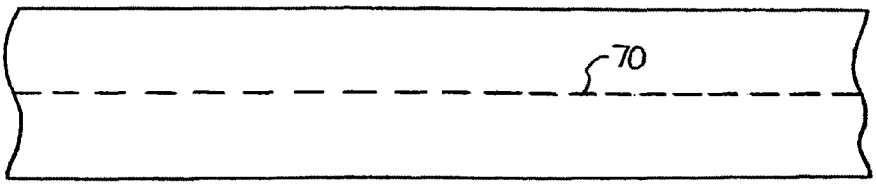
Figure 13:
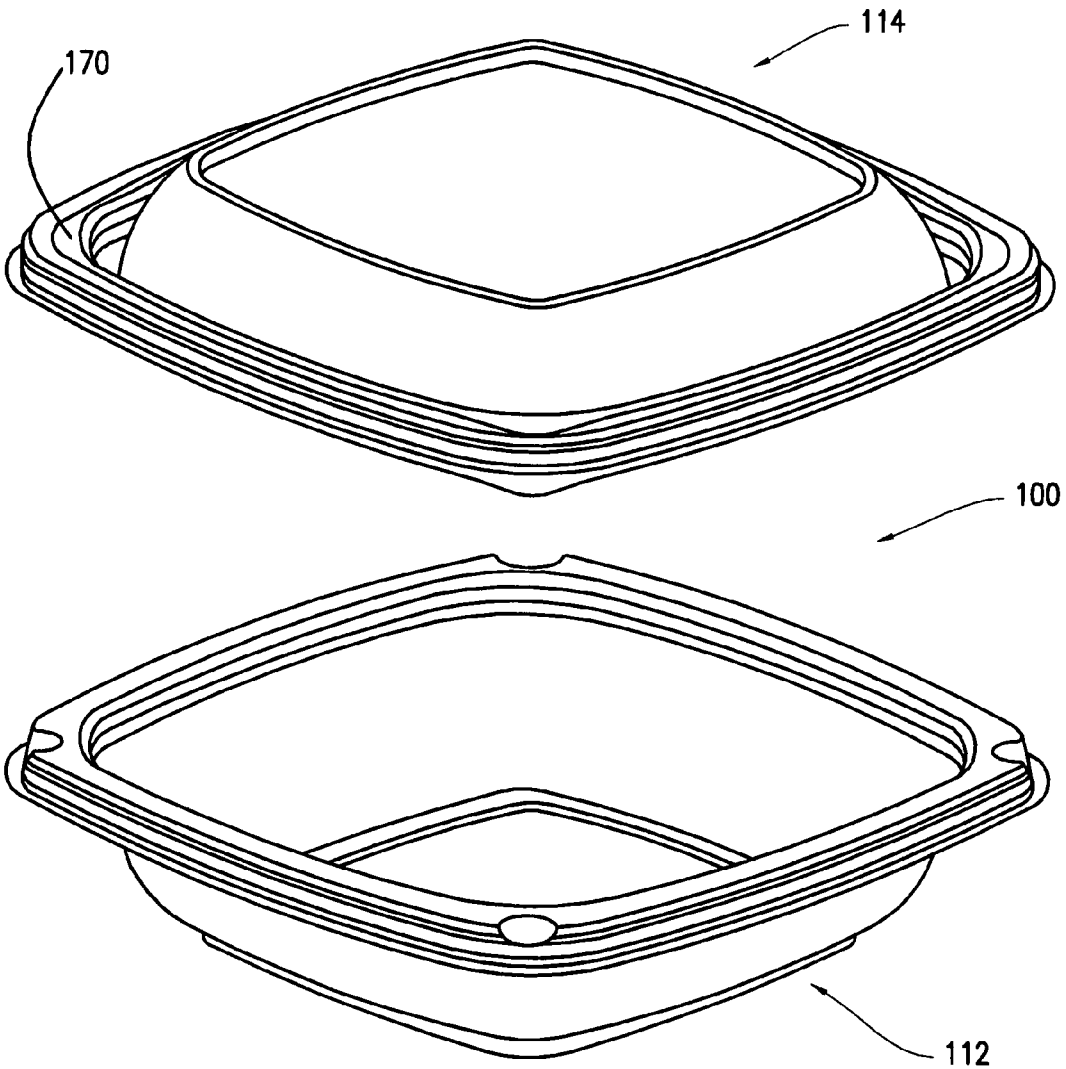
FIG. 13 is a perspective view of the second embodiment 100 showing the tray and lid separated.
Figure 14:
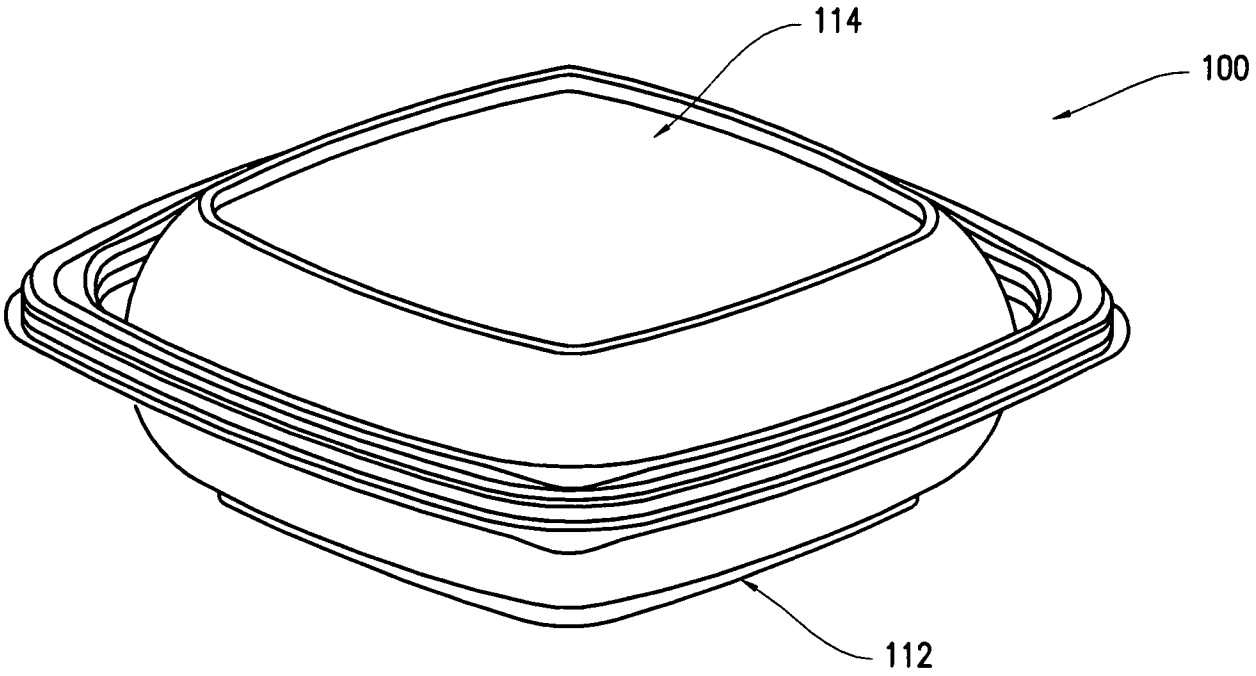
FIG. 14 is a perspective view of the second embodiment 100 showing the tray and lid assembled.
Figure 15:
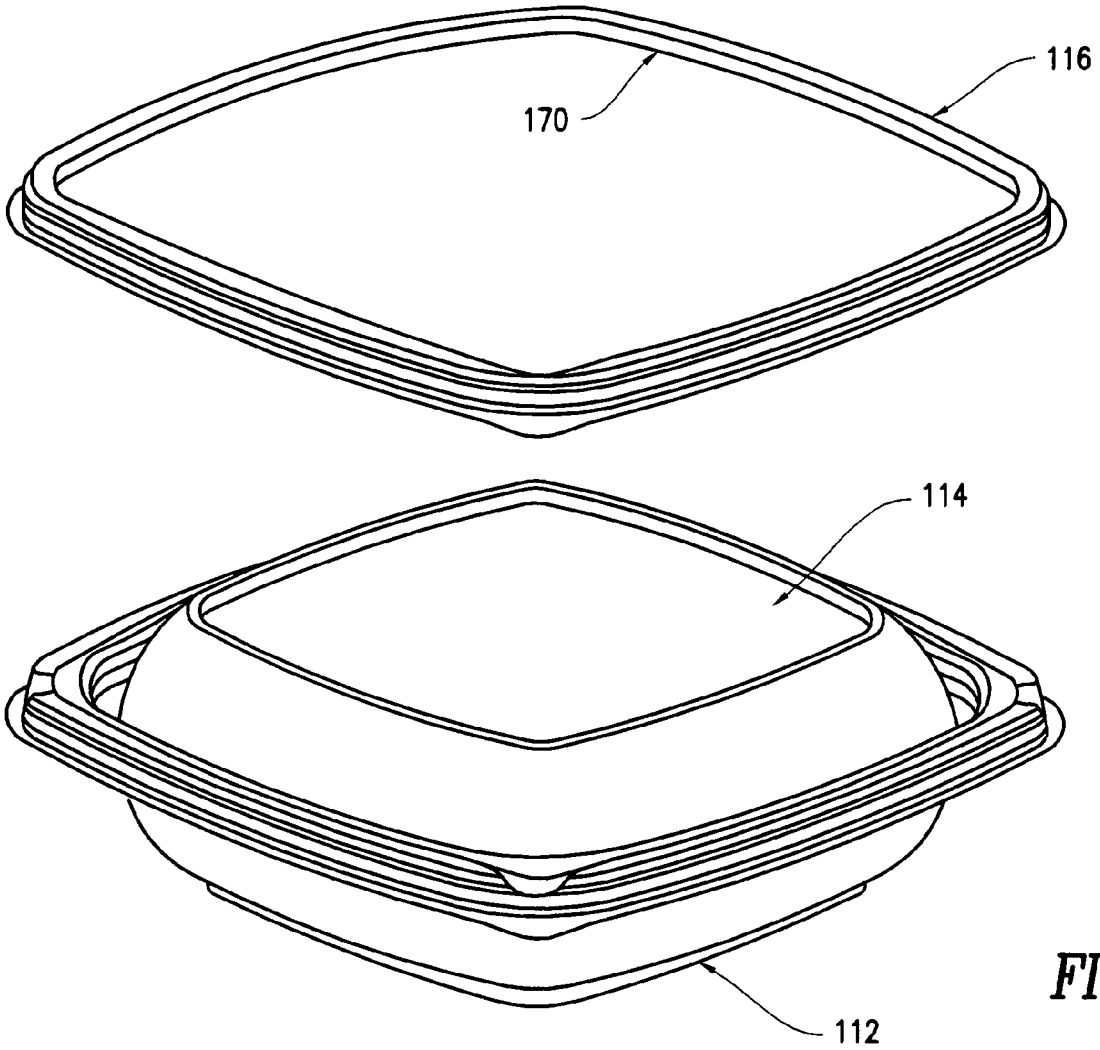
FIG. 15 is a perspective view of the second embodiment 100 showing the tear away band removed, and the tray and lid assembled.
Figure 16:
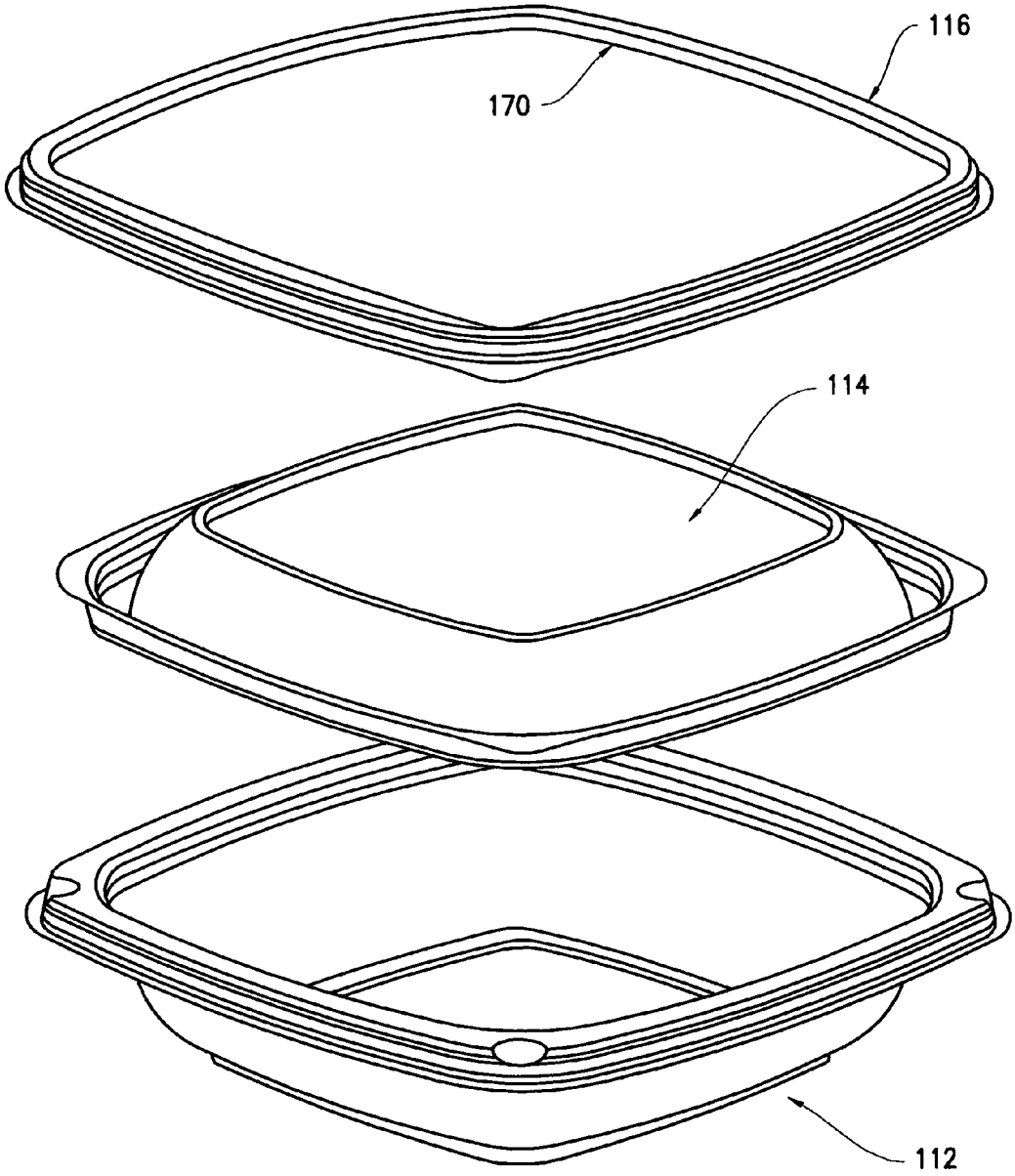
FIG. 16 is a perspective view of the second embodiment 100 showing the tear away band removed.
Figure 16A:
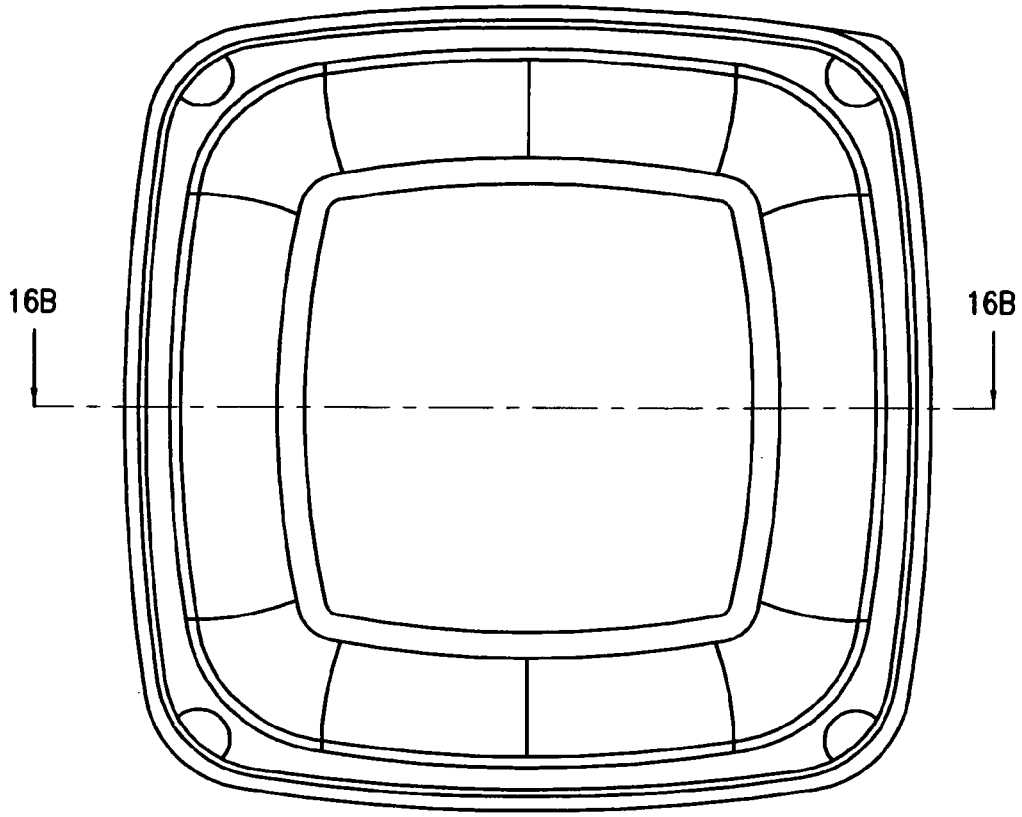
FIG. 16A is a top view of the second embodiment 100.
Figure 16B:
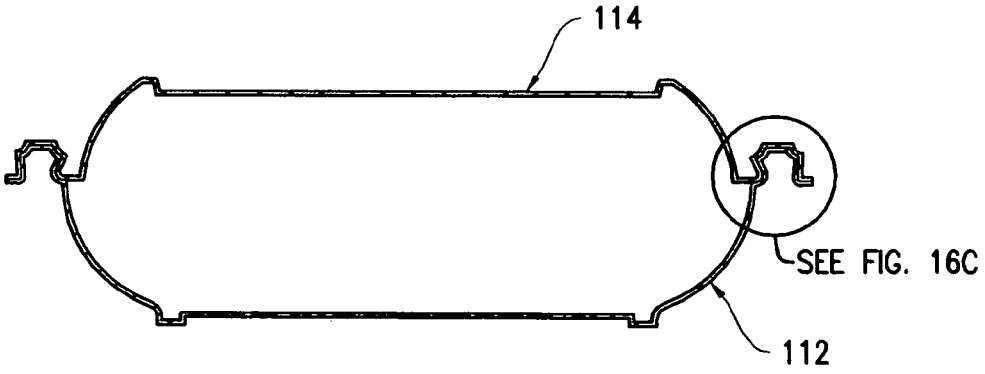
FIG. 16B is a cross sectional view of the second embodiment 100.
Figure 16C:
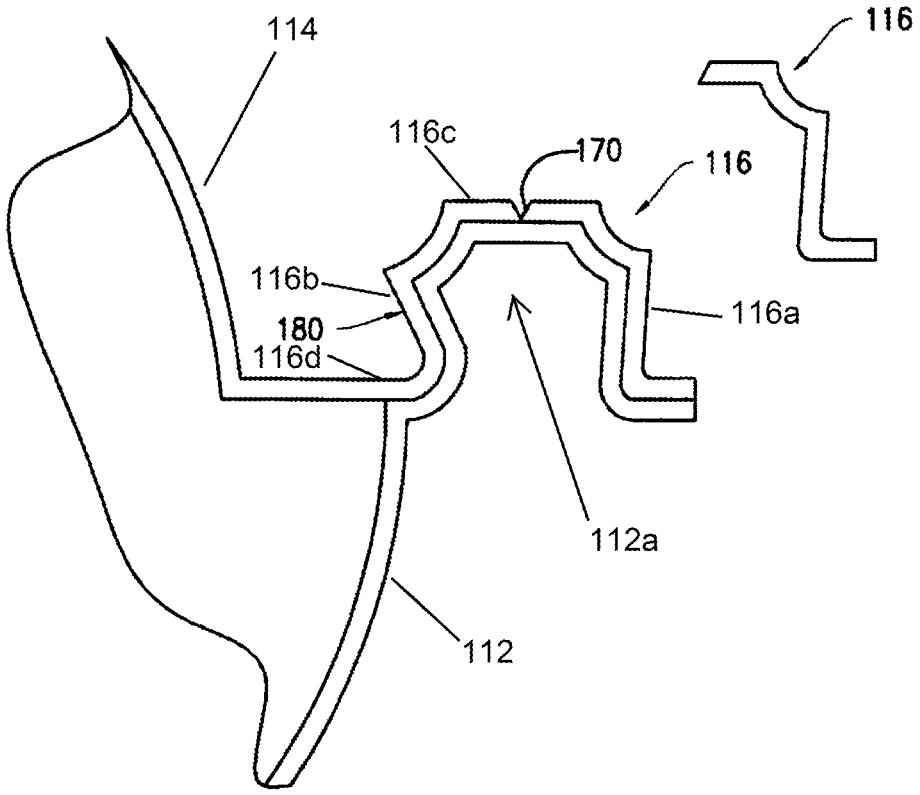
FIG. 16C is a cross sectional view of the second embodiment 100.
Figure 17:
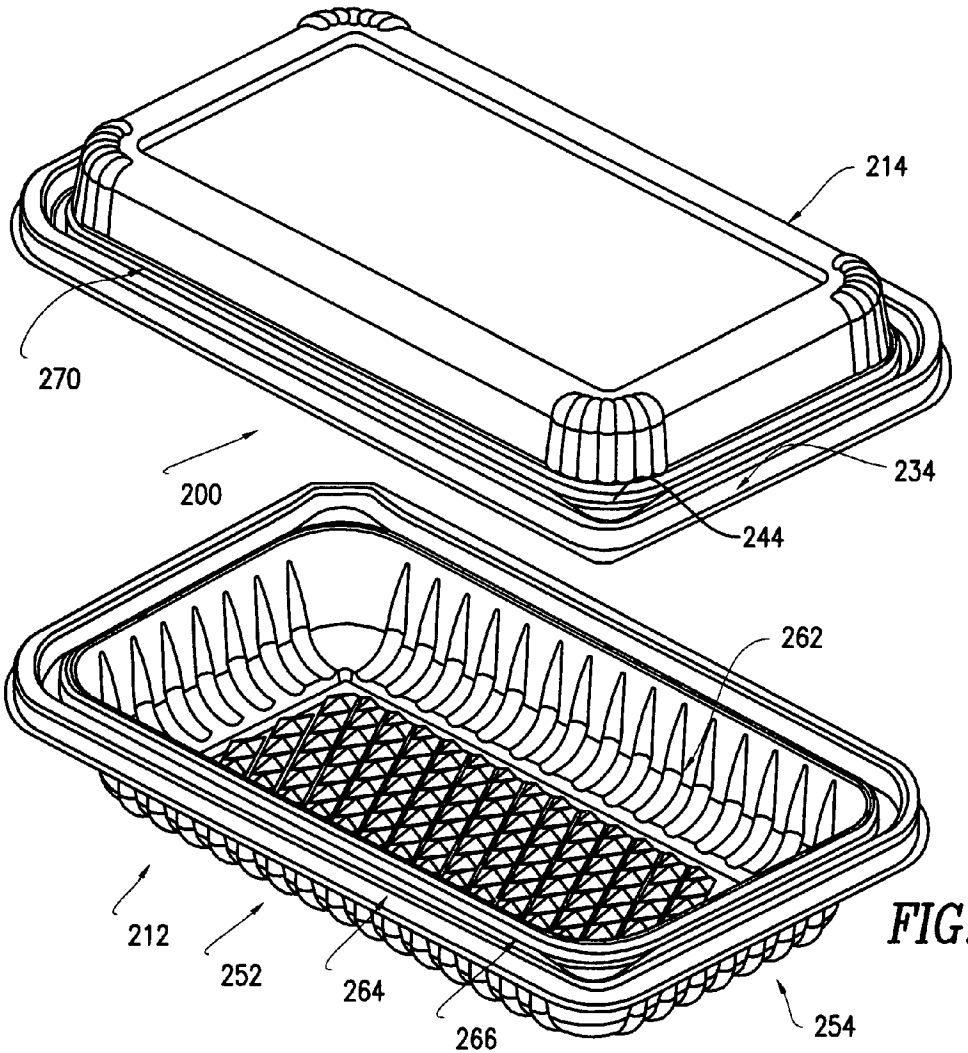
FIG. 17 is a perspective view of the third embodiment 200 showing the tray and lid separated.
Figure 18:
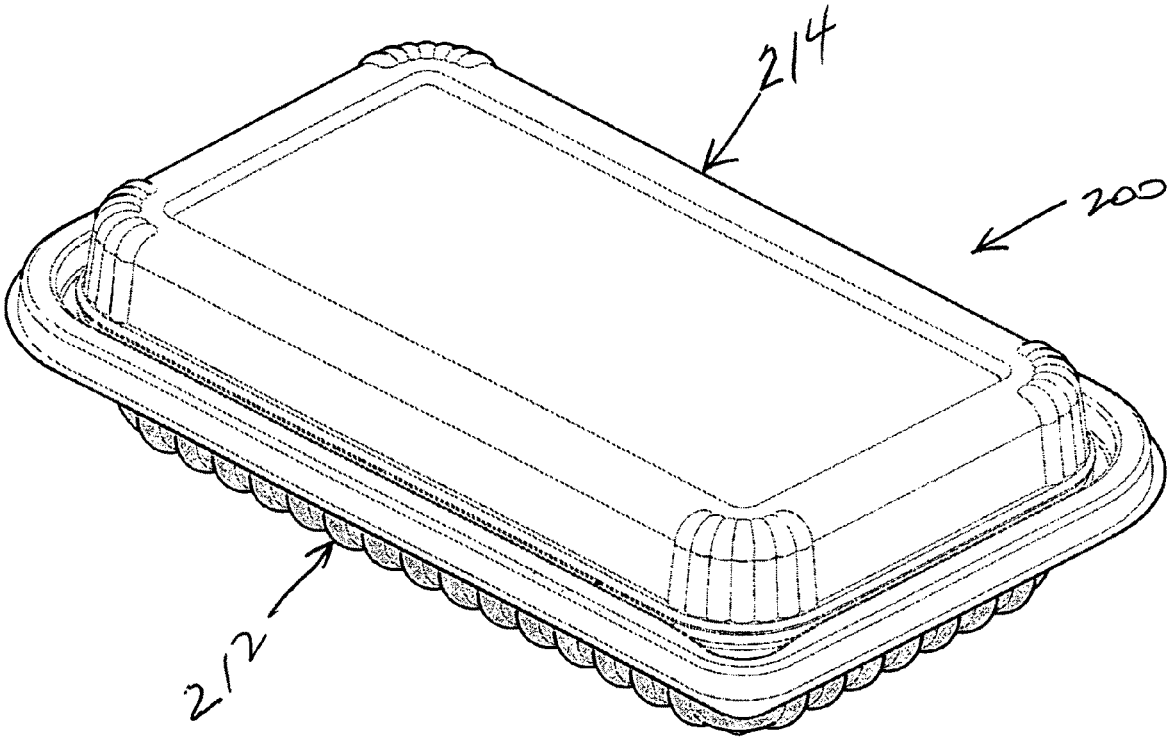
FIG. 18 is a perspective view of the third embodiment 200 showing the tray and lid assembled.
Figure 19:
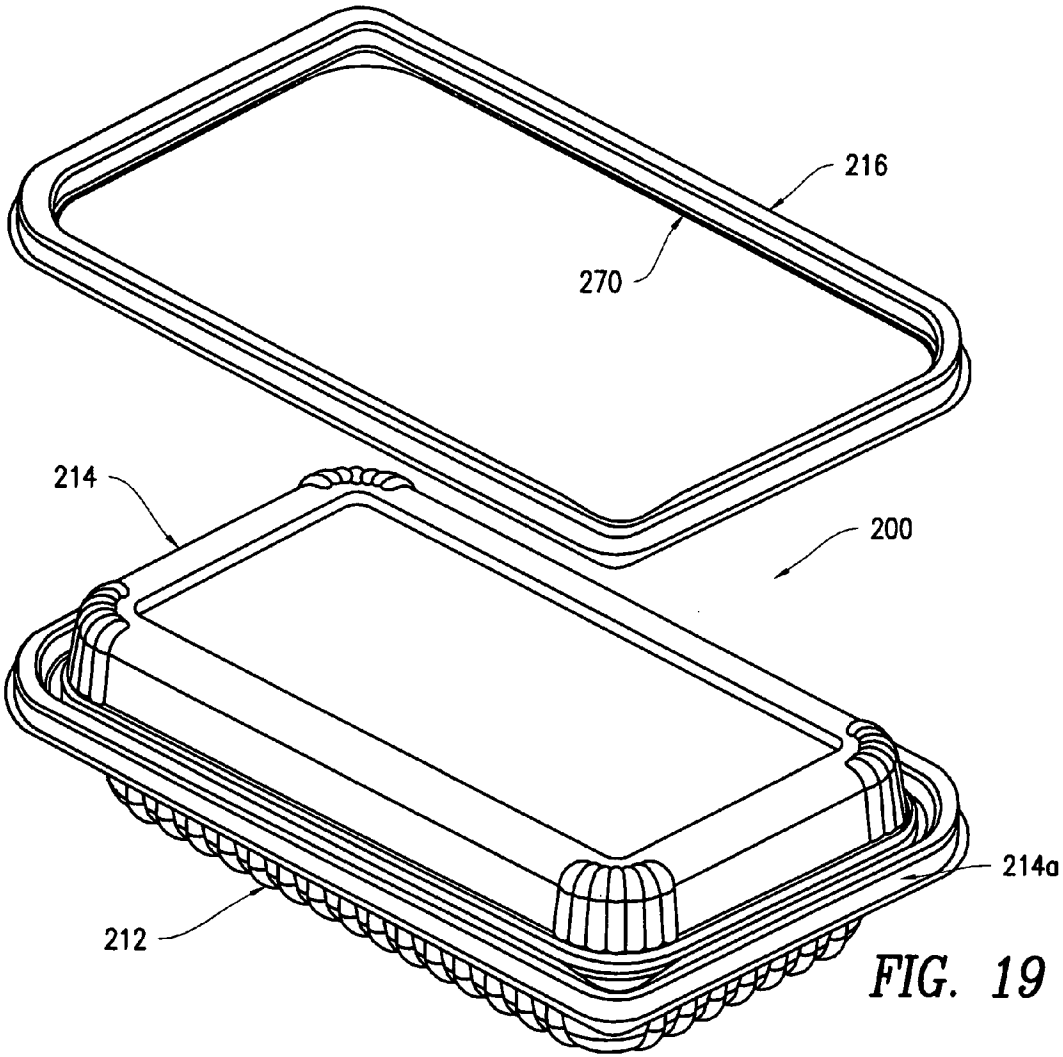
FIG. 19 is a perspective view of the third embodiment 200 showing the tray and lid assembled, and the tear away band removed.
Figure 20:
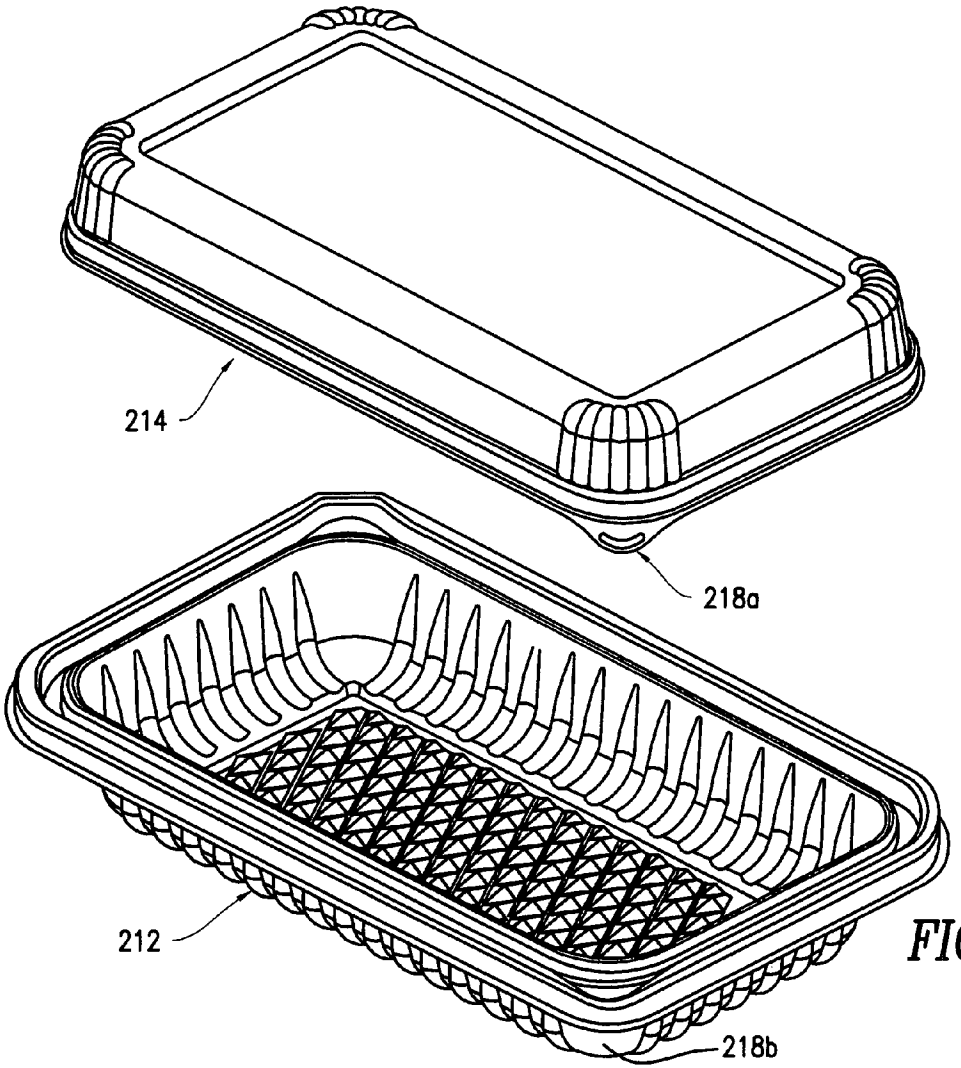
FIG. 20 is a perspective view of the third embodiment 200 showing the tray and lid being reclosed.
Figure 21:
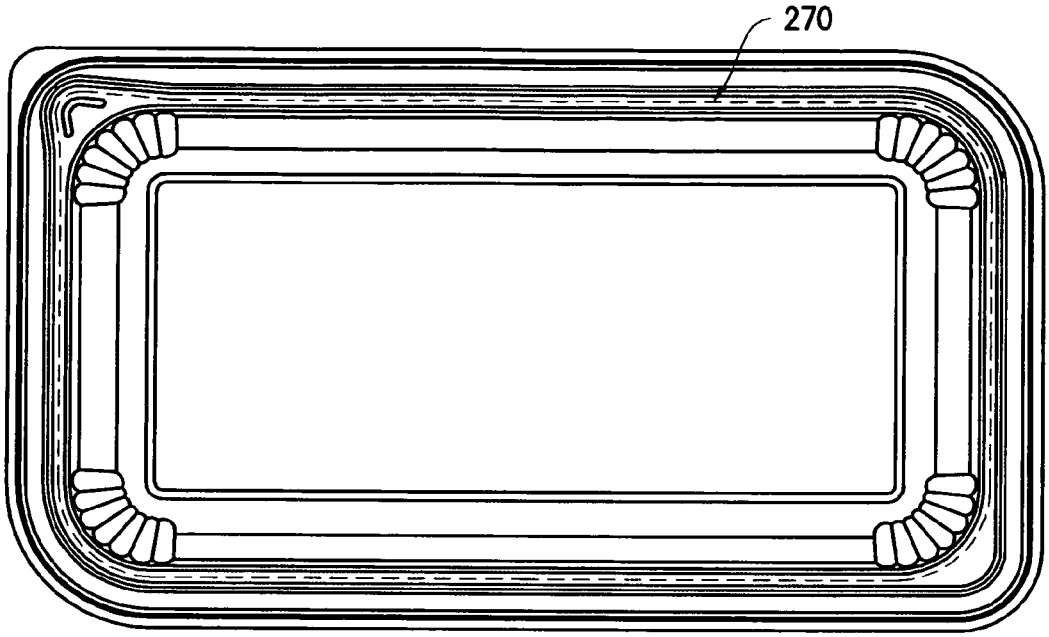
FIG. 21 is a top view of the lid showing the perforation line 270.
Figure 22:
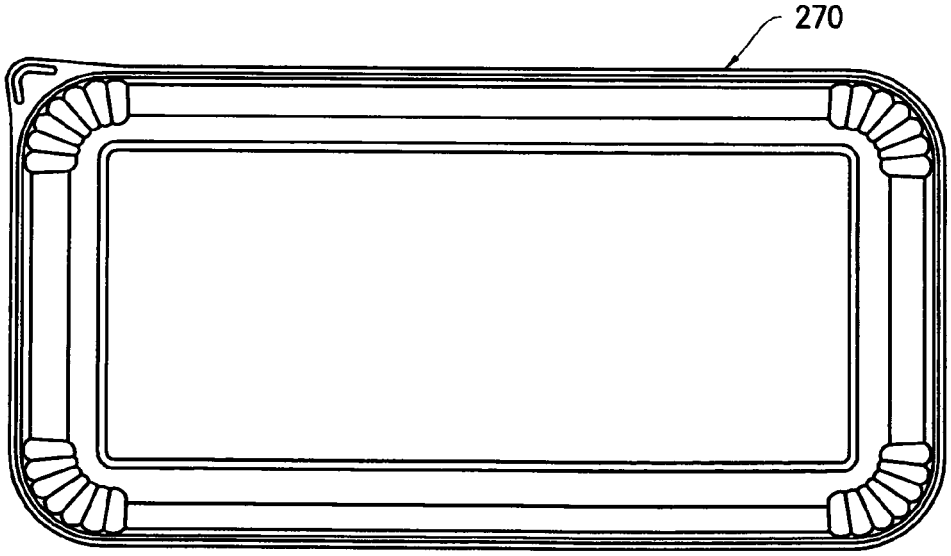
FIG. 22 is a top view of the lid.

The preferred configuration of the perforated line or section 70 is in a sine wave or zig-zag shape, as shown in FIGS. 11 and 12. The connecting plastic points can be at any location on the perforation. Alternatively, perforations 70 may be in a straight line configuration.

Figure 9:
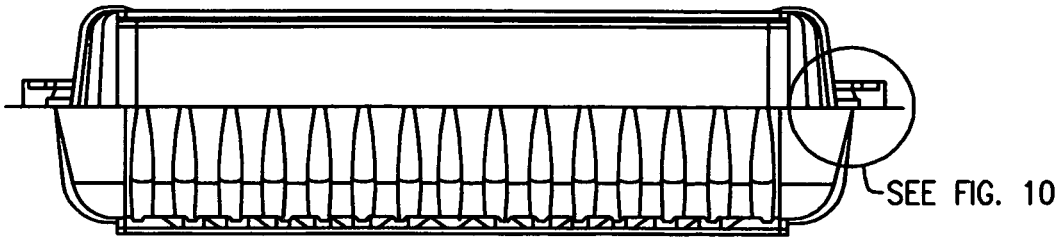
FIG. 9 is a side view of the tray and lid.
Figure 10:
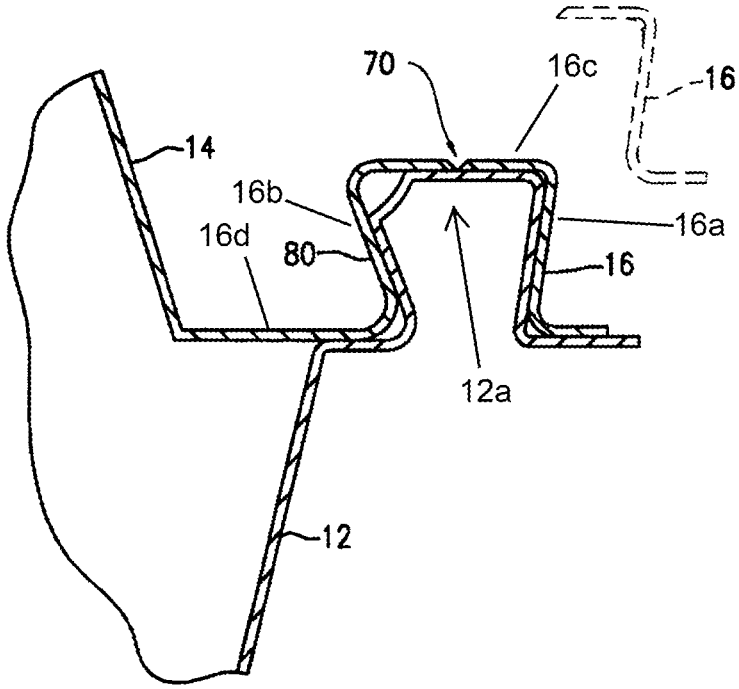
FIG. 10 is a sectional view of the tray and lid.

As shown in FIGS. 9 and 10, the seal or tear away band member 16 (in conjunction with the U-shaped section of the lid 14) includes a number of walls, including outer wall 16*a*, inner wall 16*b*, upper wall 16*c*, and a connecting wall 16*d*, which fits over the outer U-shaped section 12*a* of the tray 12.

In this manner, tamper-evident seal or tear away band 16 may be torn away from lid 14, along perforated section 70, which extends along the periphery of the lid 14. Then, opening tab 18*b* is used to lift up lid 14 and remove it from tray 12. When the user wants to re-close the lid 14 on the tray 12, it snaps in place.

Second Embodiment 100

The combined tamper evident food container 100 and its component parts of the second embodiment 100 of the present invention are represented in detail by FIGS. 13 to 16 of the patent drawings. Elements illustrated in FIGS. 13 to 16 which correspond to the elements described above with reference to FIGS. 1 through 12 of the first embodiment 10 have been designated by corresponding reference numbers.

The second embodiment 100 is similarly constructed and operates in the exact same manner as the preferred embodiment 10, unless it is otherwise stated. All elements of the second embodiment 100 of the combined tamper evident food container are the same as the first embodiment of the tamper evident food container 10, except for the cover lid 114 and the base tray 112 having a square configuration.

The combined tamper evident food container 100 has a base tray 112, a cover lid 114, and a tamper evident removable seal 116, which are represented in detail by FIGS. 13 through 16 of the patent drawings. The combined tamper evident food container 100 is used for holding food product(s) within the tray 112, such that the cover lid 114 is locked in place by the tamper evident removable seal 116, for showing a consumer that the container has not been tampered with and that the securing seal 116 has not been broken. The cover lid 114 is made from transparent plastic materials Pt or non-transparent materials, which in the preferred embodiment is PET. The base tray 112 is made from transparent or non-transparent plastic materials Ps, which in the preferred embodiment is PET. Alternatively, other plastic materials may be used, such as HDPE, PP, PS, and PLA (poly lactic acid), to form the tray 112 and lid 114.

As shown in FIGS. 13 through 16 of the drawings, the base tray 112 includes tray side walls 152, 154, 156 and 158 and a bottom wall 160 for forming an interior base compartment 162. The tray side walls 152 to 158 of the interior base compartment 162 includes an upper peripheral edge 164. The upper peripheral edge 164 includes an upper peripheral receiving section 166 being adjacent to the tray side walls 152 to 158 of the base tray 112. Additionally, the upper peripheral receiving section 166 on the interior compartment 162 of the tray 112 is for detachably receiving the perimeter lid edge 134 of the lid interior compartment 132 of the cover lid 114, for locking the cover lid 114 to the tray 112, forming a locking area 180.

The plastic lid 114 is thermoformed with an integrally formed plastic tear away band or seal 116 at the periphery of the lid 114 along a perforation line 170 which is formed in the top of the band 116. The perforation line 170 removably connects the lid 114 and the tear away band or seal 116, so that the user can tear away the seal 116 from the periphery of the lid 114, and unseal the container 100. The tray 12 includes a corner tab 118*a*, and the lid 114 also includes an opening tab 118*b* to lift up lid 114 and remove it from tray 112.

The preferred configuration of the perforated section 170 is in a sine wave or zig-zag shape, as shown in FIGS. 11 and 12. The connecting plastic points can be at any location on the perforation. Alternatively, perforations 170 may be in a straight line configuration.

As shown in FIGS. 15, 16, and 16A-16C, the seal or tear away member 116 (in conjunction with the U-shaped section of the lid 114) includes a number of walls, including outer wall 116*a*, inner wall 116*b*, upper wall 116*c*, and a connecting wall 116*d*, which fits over the outer U-shaped section 112*a* of the tray 112.

In this manner, tamper-evident seal or tear away band 116 may be torn away from lid 114, along perforated section 170, which extends around the lid 114. Then, opening tab 118*b* is used to lift up lid 114 and remove it from tray 112. When the user wants to reclose the lid 114 on the tray 112, it snaps in place.

Third Embodiment 200

The combined tamper evident food container 200 and its major component parts of the third embodiment are represented in detail by FIGS. 17 through 25 of the patent drawings. Elements illustrated in FIGS. 17 through 25 which correspond to the elements described above with reference to FIGS. 1 through 16 of the preferred embodiments 10 and 100 have been designated by corresponding reference numbers.

The third embodiment 200 is similarly constructed and operates in the exact same manner as the embodiments 10 and 100, unless it is otherwise stated. All elements of the third embodiment 200 of the combined tamper evident food container are the same as the tamper evident food containers 10 and 100, except for the cover lid 214 and the base tray 212 being rectangular in configuration.

The combined tamper evident food container 200 has a base tray 212, a cover lid 214, and a tamper evident removable seal 216, which are represented in detail by FIGS. 13 through 16 of the patent drawings. The combined tamper evident food container 200 is used for holding food product(s) within the tray 212, such that the cover lid 214 is locked in place by the tamper evident removable seal 216, for showing a consumer that the container has not been tampered with and that the securing seal 216 has not been broken. The cover lid 214 is made from transparent plastic materials Pt or non-transparent materials, which in the preferred embodiment is PET. The base tray 212 is made from transparent or non-transparent plastic materials Ps, which in the preferred embodiment is PET. Alternatively, other plastic materials may be used, such as HDPE, PP, PS, and PLA (poly lactic acid), to form the tray 212 and lid 214.

As shown in FIGS. 17 through 25 of the drawings, the base tray 212 includes tray side walls 252, 254, 256 and 258 and a bottom wall 260 for forming an interior base compartment 262. The tray side walls 252 to 258 of the interior base compartment 262 includes an upper peripheral edge 264. The upper peripheral edge 264 includes an upper peripheral receiving section 266 being adjacent to the tray side walls 252 to 258 of the base tray 212. Additionally, the upper peripheral receiving section 266 on the interior compartment 262 of the tray 212 is for detachably receiving the perimeter lid edge 234 of the lid interior compartment 232 of the cover lid 214, for locking the cover lid 214 to the tray 212, in locking area 280.

The plastic lid 214 is thermoformed with an integrally formed plastic tear away band or seal 216 at the periphery of the lid 214, and a perforation line 270 is formed in the locking area 280. The perforation line 270 removably connects the lid 214 and the tear away band or seal 216, so that the user can tear away the seal 216 from the periphery of the lid 214, and unseal the container 200. The tray 212 includes a corner tab 218*a*, and the lid 114 also includes an opening tab 218*b* to lift up lid 214 and remove it from tray 212.

The preferred configuration of the perforated section 270 is in a sine wave or zig-zag shape. The connecting plastic points can be at any location on the perforation. Alternatively, perforations 270 may be in a straight line configuration.

Figure 23:
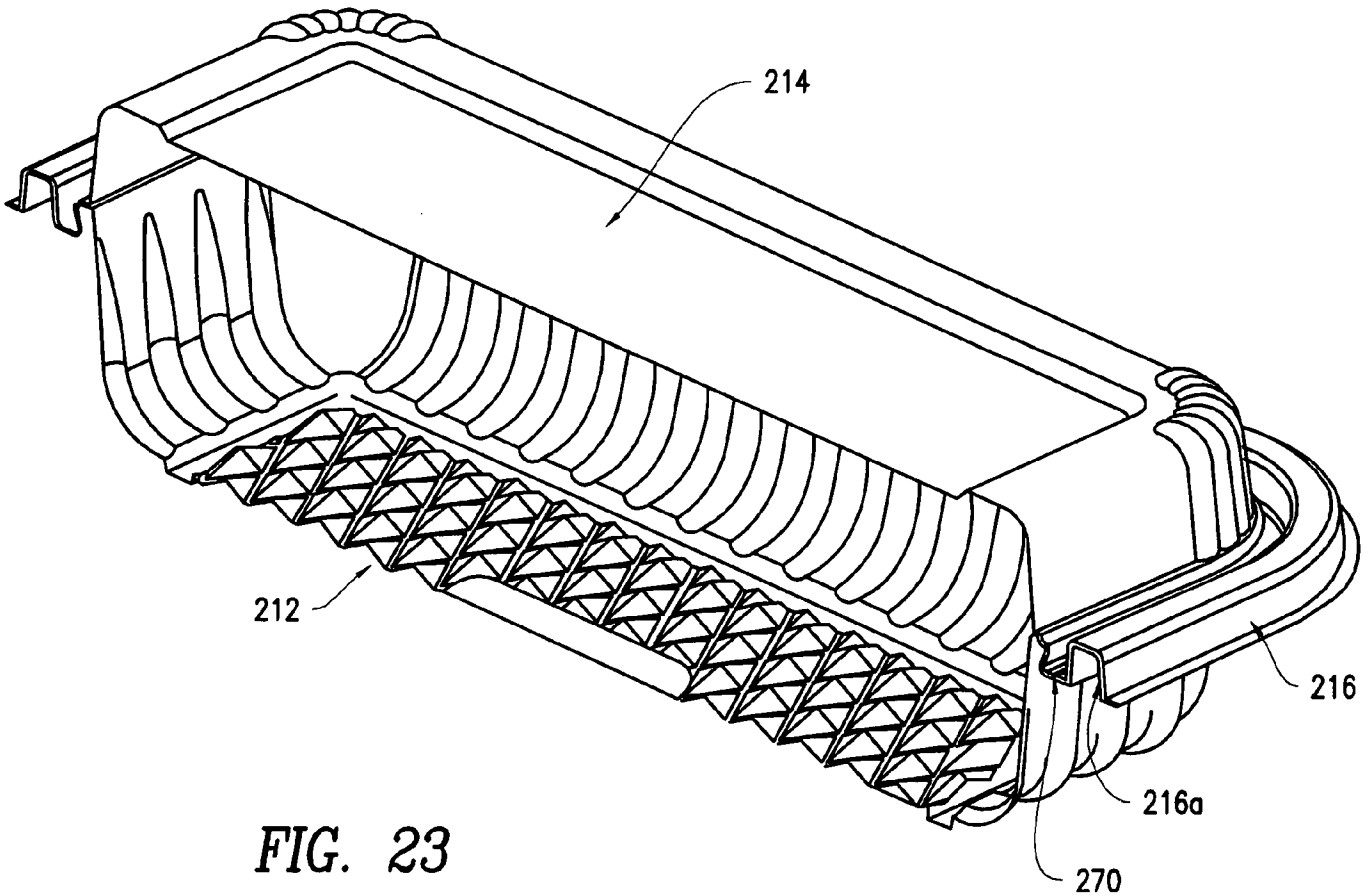
FIG. 23 is a sectional view of the third embodiment 200 showing the tray and lid, with the perforation line 270 in the locking area 280.
Figure 24:
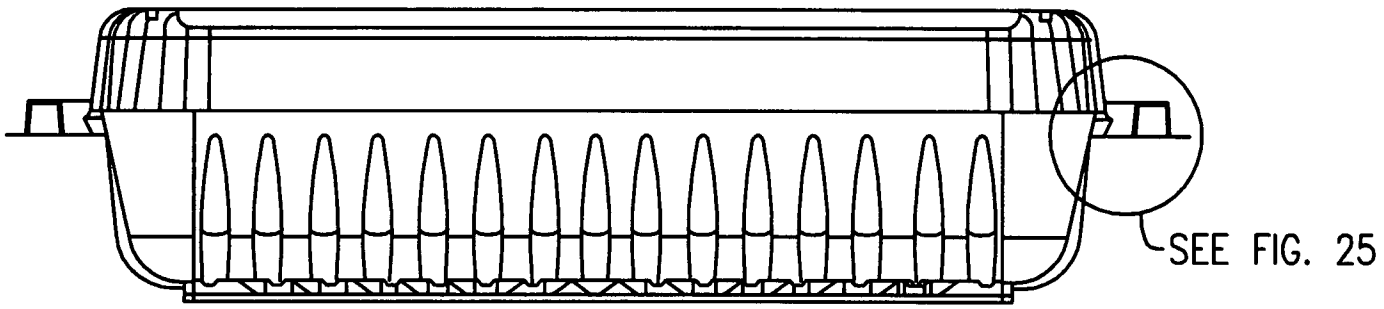
FIG. 24 is a side view of the third embodiment 200 showing the tray and lid.
Figure 25:
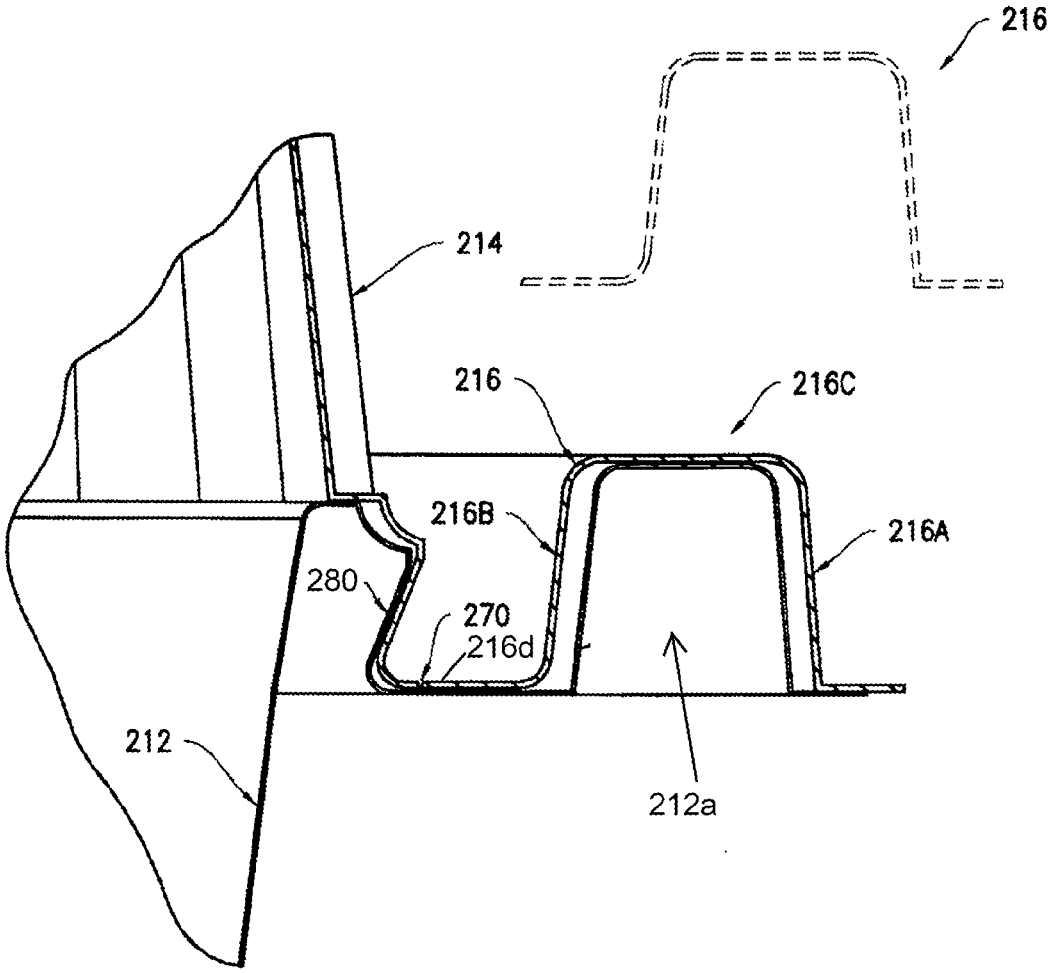
FIG. 25 is a sectional view showing in detail the mating of the lid and tray, with the perforation line 270 in the locking area 280.
Figure 26:
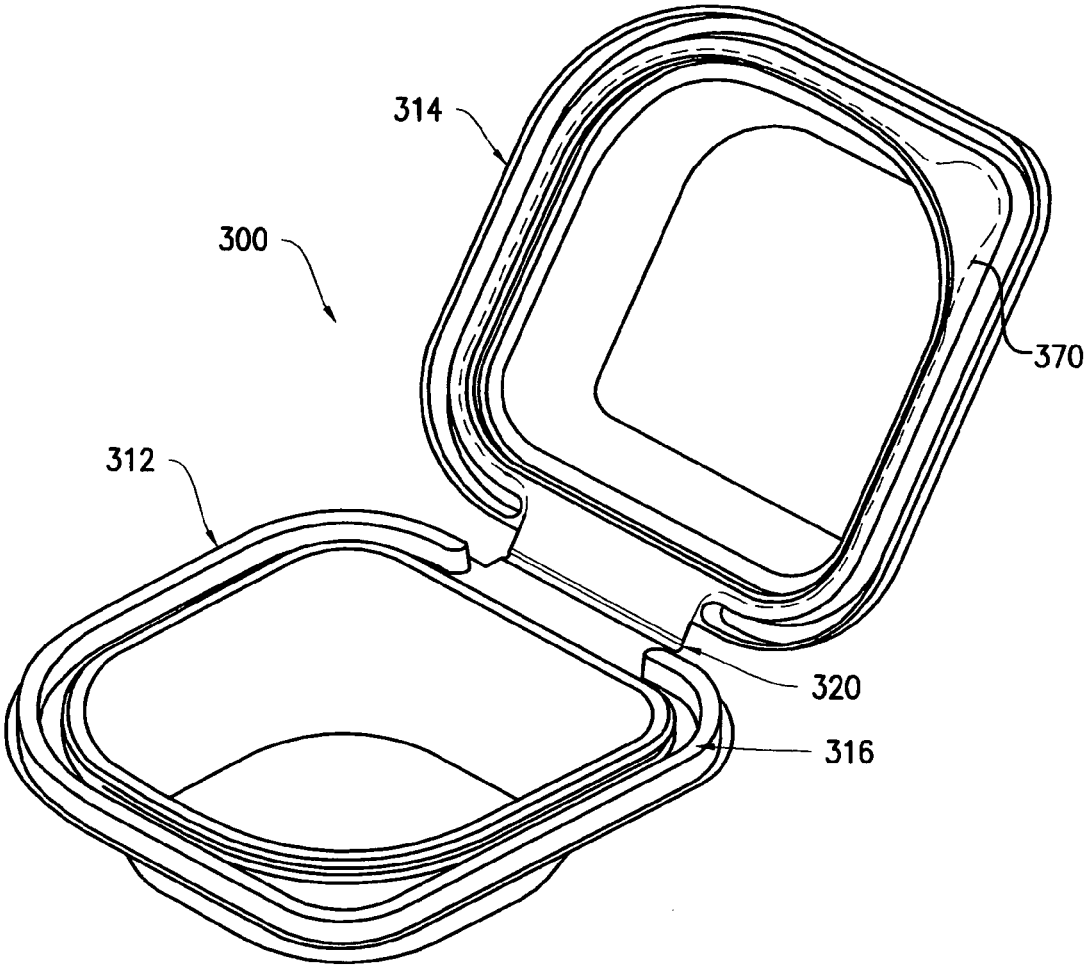
FIG. 26 is a perspective view of the fourth embodiment 300 with the lid in the open position.
Figure 27:
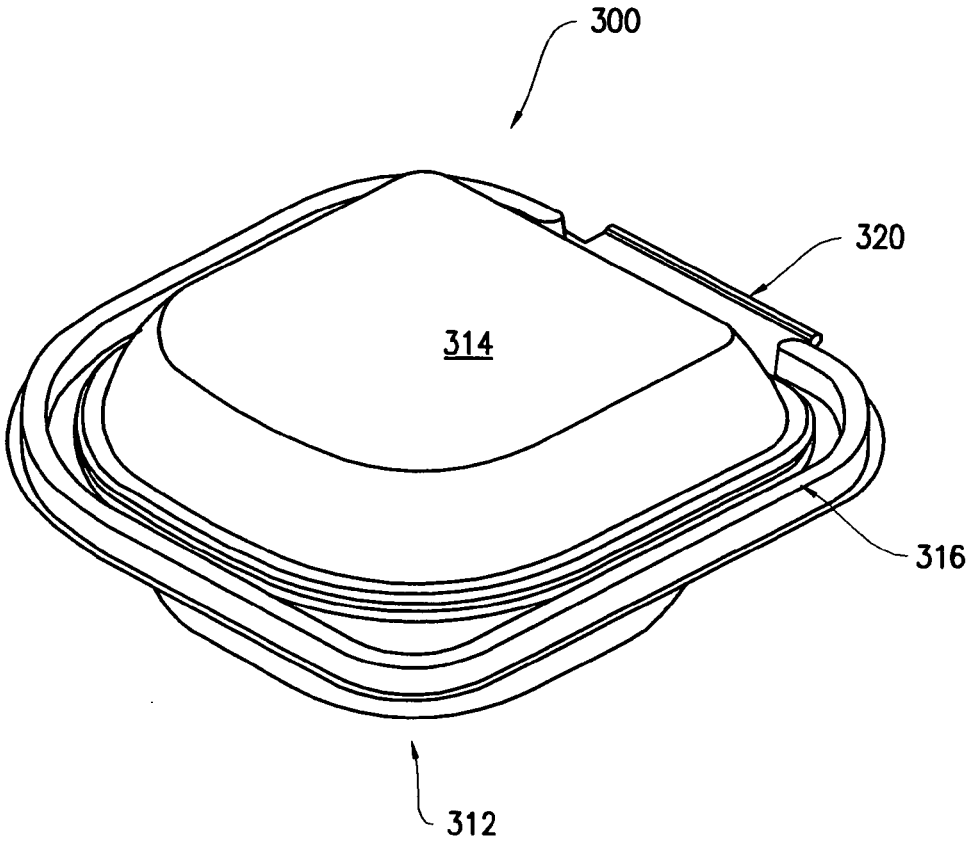
FIG. 27 is a perspective view of the fourth embodiment 300 with the lid in the closed position.
Figure 28:
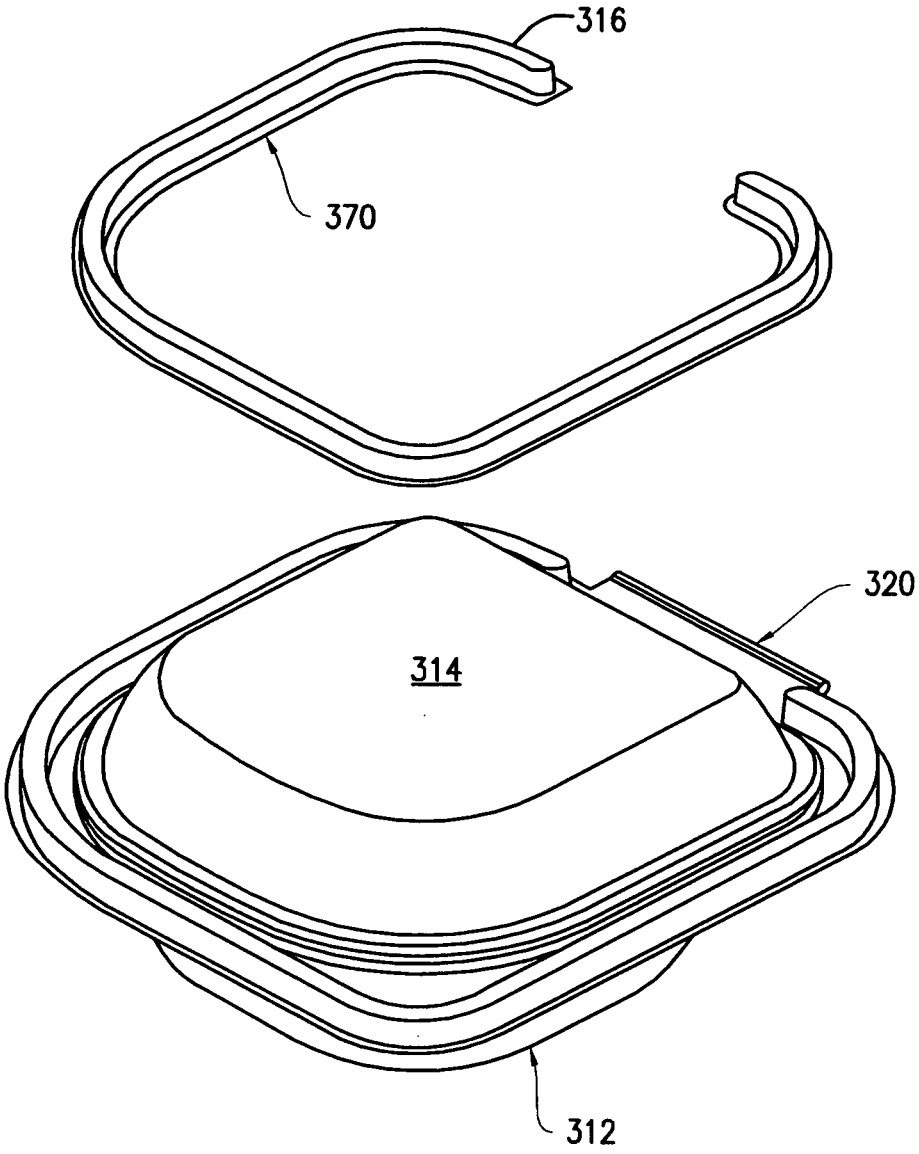
FIG. 28 is a perspective view of the fourth embodiment 300 with the lid in the closed position, and the tear away band removed.
Figure 29:
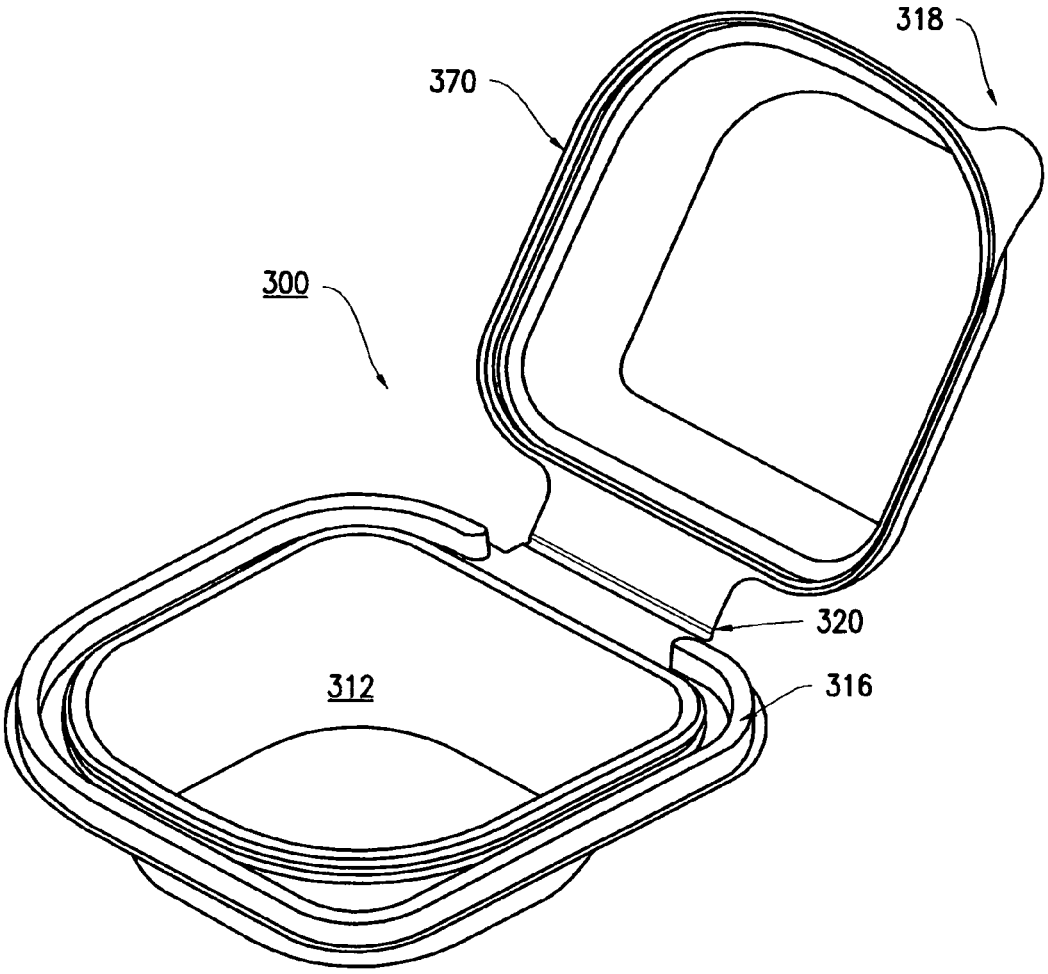
FIG. 29 is a perspective view of the fourth embodiment 300 with the lid in the open position, and the tear away band removed.

As shown in FIGS. 23 and 25, the seal or tear away member 216 includes a number of walls, including outer wall 216*a*, inner wall 216*b*, upper wall 216*c*, and a connecting wall 216*d*, which fits over the outer u-shaped section 212*a* of the lid 211 tray 212.

In this manner, tamper-evident seal or tear away band 216 may be torn away from lid 214, along perforated section 270, which extends around the lid 214. Then, opening tab 218*b* is used to lift up lid 214 and remove it from tray 212. When the user wants to reclose the lid 214 on the tray 212, it snaps in place.

Fourth Embodiment 300

The combined tamper evident food container 300 and its major component parts of the fourth embodiment are represented in detail by FIGS. 26 through 32 of the patent drawings. Elements illustrated in FIGS. 26 through 32 which correspond to the elements described above with reference to FIGS. 1 through 16 of the preferred embodiments 10, 100, and 200 have been designated by corresponding reference numbers.

The fourth embodiment 300 is similarly constructed and operates in the exact same manner as the preferred embodiments 10, 100, and 200, unless it is otherwise stated. All elements of the fourth embodiment 300 of the combined tamper evident food container are the same as the tamper evident food containers 10, 100, and 200, except for the cover lid 314 and the base tray 312 being square in configuration, which are connected by a hinge 320.

The combined tamper evident food container 300 has a base tray 312, a cover lid 314, and a tamper evident removable seal 316, which are represented in detail by FIGS. 13 through 16 of the patent drawings. The combined tamper evident food container 300 is used for holding food product(s) within the tray 312, such that the cover lid 314 is locked in place by the tamper evident removable seal 316, for showing a consumer that the container has not been tampered with and that the securing seal 316 has not been broken. The cover lid 314 is made from transparent plastic materials Pt or non-transparent materials, which in the preferred embodiment is PET. The base tray 312 is made from transparent or non-transparent plastic materials Ps, which in the preferred embodiment is PET. Alternatively, other plastic materials may be used, such as HDPE, PP, PS, and PLA (poly lactic acid), to form the tray 312 and lid 314.

As shown in FIGS. 26 through 32 of the drawings, the base tray 312 includes tray side walls 352, 354, 356 and 358 and a bottom wall 360 for forming an interior base compartment 362. The tray side walls 352 to 358 of the interior base compartment 362 includes an upper peripheral edge 364. The upper peripheral edge 364 includes an upper peripheral receiving section 366 being adjacent to the tray side walls 352 to 358 of the base tray 312. Additionally, the upper peripheral receiving section 366 on the interior compartment 362 of the tray 312 is for detachably receiving the perimeter lid edge 334 of the lid interior compartment 332 of the cover lid 314, for locking the cover lid 314 to the tray 312, in the locking area 380.

The plastic lid 314 is thermoformed with an integrally formed plastic tear away band or seal 316 at the periphery of the lid 314, and a perforation line 370 is formed in the locking area 380. The perforation line 370 removably connects the lid 314 and the tear away band or seal 316, so that the user can tear away the seal 316 from the periphery of the lid 314, and unseal the container 300. The tray 312 includes a corner tab 318*a*, and the lid 314 also includes an opening tab 318*b* to lift up lid 314 and remove it from tray 312.

The preferred configuration of the perforated section 370 is in a sine wave or zig-zag shape. The connecting plastic points can be at any location on the perforation. Alternatively, perforations 370 may be in a straight line configuration.

Figure 30:
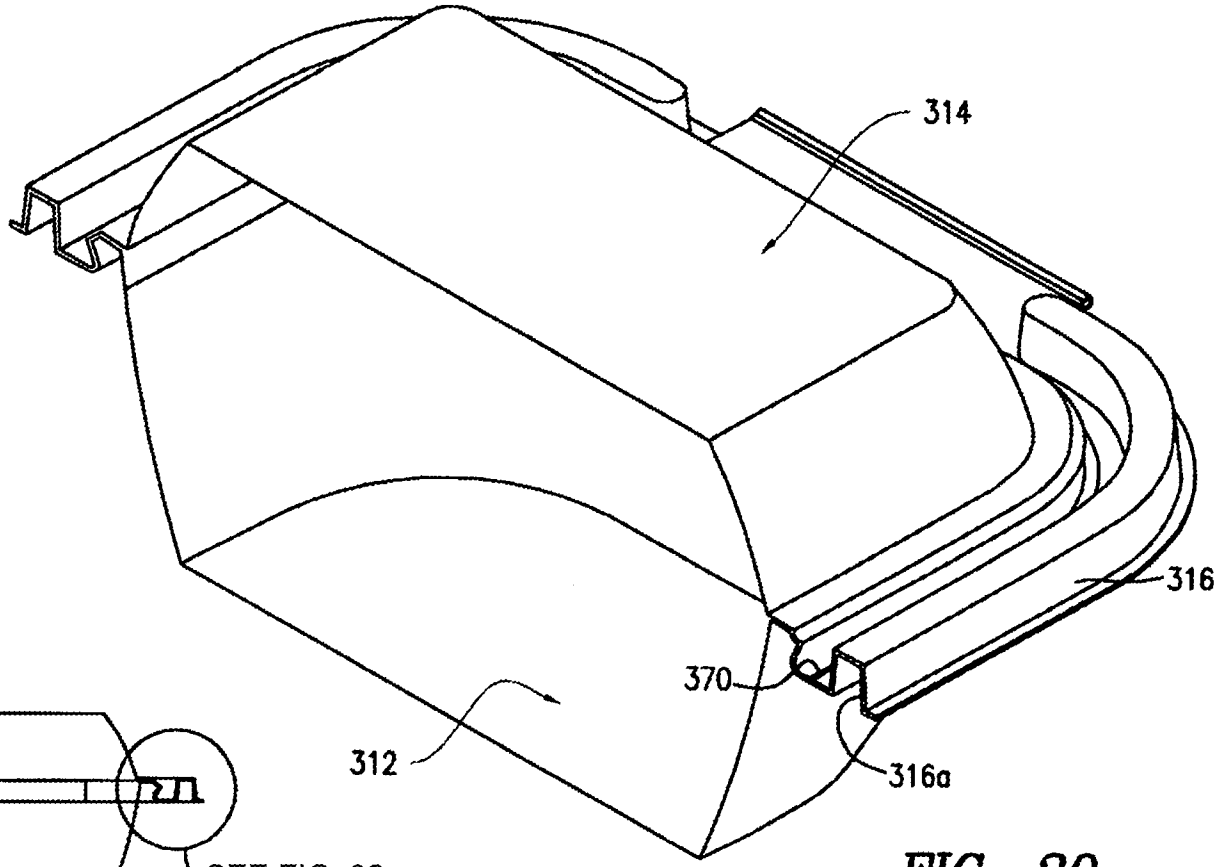
FIG. 30 is a sectional view of the fourth embodiment 300 of the tray and lid.
Figure 31:
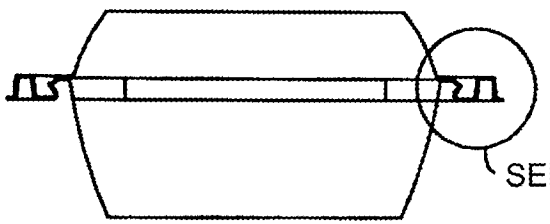
FIG. 31 is a side view of the tray and lid.
Figure 32:
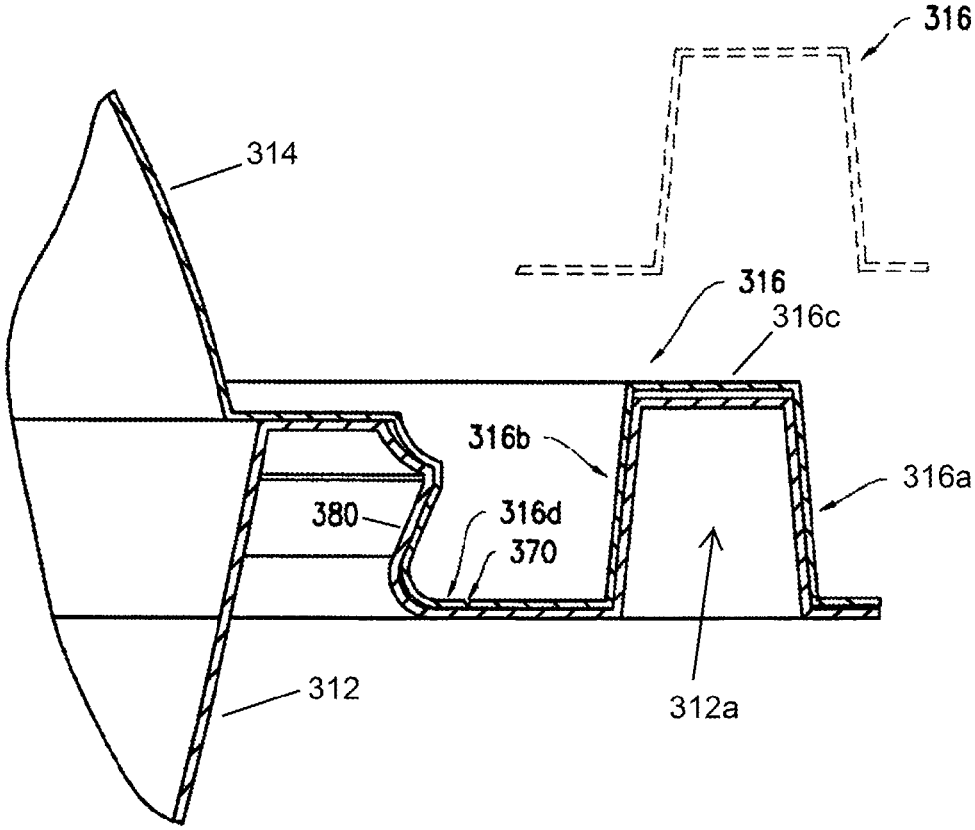
FIG. 32 is a sectional view of the fourth embodiment 300 showing in detail the mating of the lid and tray.

As shown in FIGS. 30 and 32, the seal member 316 includes a number of walls, including outer wall 316*a*, inner wall 316*b*, upper wall 316*c*, and a connecting wall 316*d*, which fits over the outer u-shaped section 314*a* of the lid 314.

In this manner, tamper-evident seal 316 may be torn away from lid 314, along perforated section 370, which extends around the lid 314. Then, opening tab 318 is used to lift up lid 314 and remove it from tray 312. When the user wants to reclose the lid 314 on the tray 312, it snaps in place.

Operation of the Present Invention

As shown in FIGS. 1 through 32 of the drawings, the combined tamper evident food containers 10, 100, 200 and 300 are assembled and are operated in the following manner: Initially, the food packager starts the assembly process by placing the hot or cold food product(s) in the interior base compartment 62 of the base tray 12. The food packager now places the cover lid 14 on the base tray 12, such that the corner tab 18 and tear away band 16 are in position to be removed when the container 10 is to be opened.

After the consumer has checked that the sealed and locked food container 10 at the food store/supermarket has not been tampered with, the consumer now purchases the food product(s) within the food container 10. When the consumer is ready to extract the food product(s) from the food container 10, then the consumer pulls tab 18*b* to initiate the tear along perforated section 70 to remove tear away band 16, in order to removably detach band 16 from periphery of the lid 14 along the perforated line or section 70. Then, using tab 18*c* the consumer lifts the lid 14 from the tray 12. The consumer now removes the food product(s) from the base tray 12.

Figure 7:
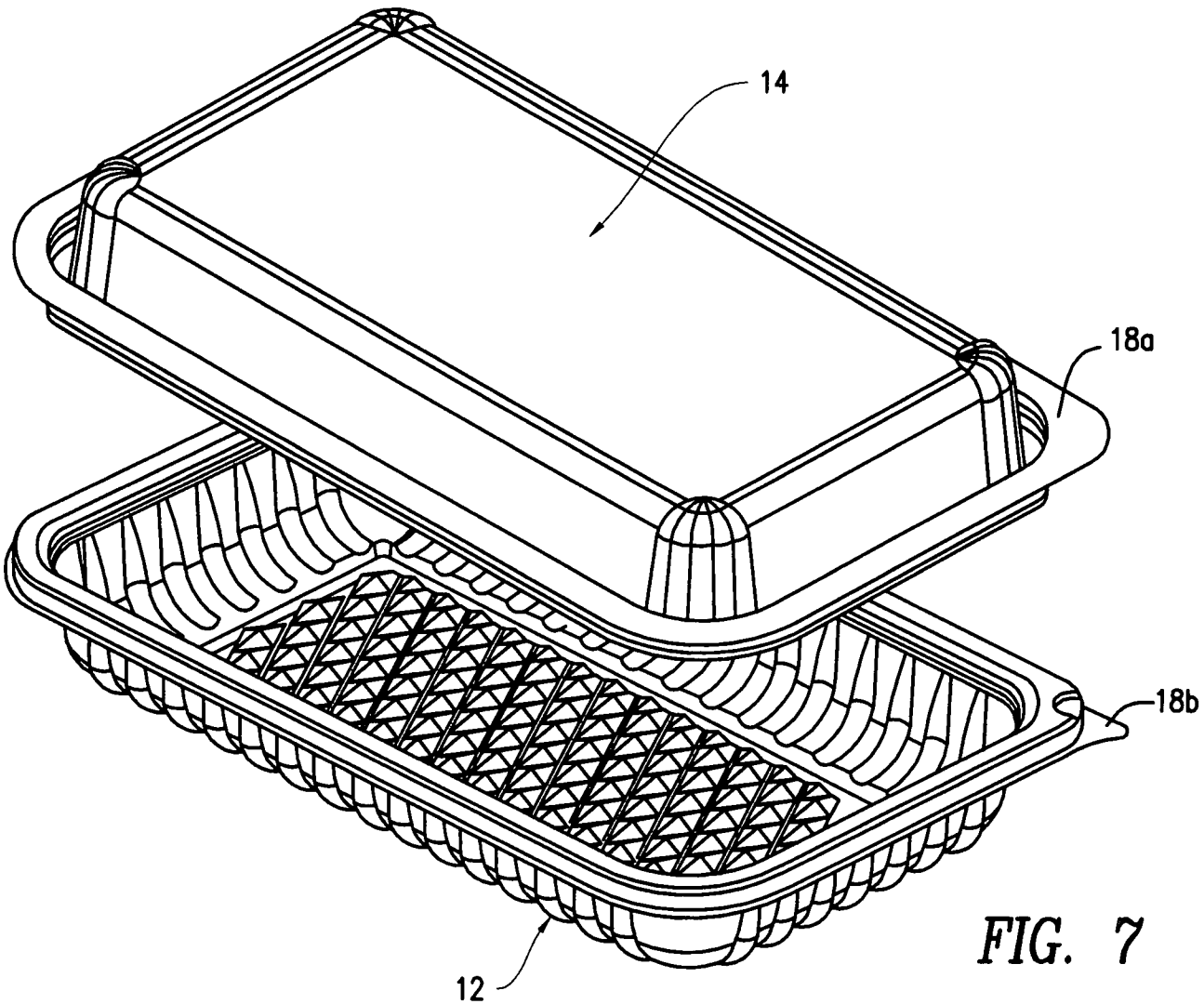
FIG. 7 is a perspective view of the lid being replaced on the tray.
Figure 8:
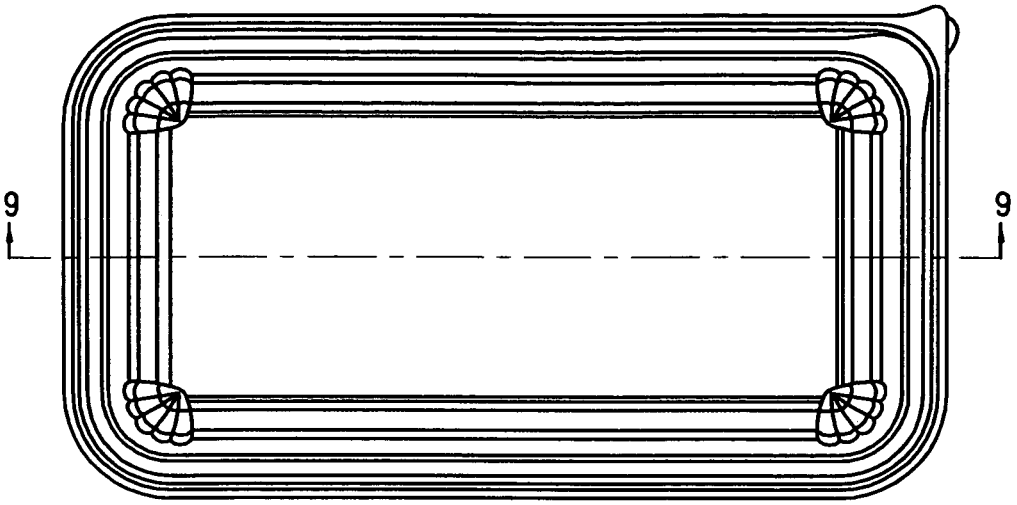
FIG. 8 is a top view of the lid.

Further, any left-over food product(s) can now be placed back into the base tray 12, and re-covered with the cover lid 14 by having the perimeter lid edge 34 of the lid interior compartment 32 received within the upper peripheral receiving section 66 on the interior base compartment 62 of the base tray 12 for detachably locking the cover lid 14 to the base tray 12, as shown in FIG. 7. Additionally, each of the locking members 72 and 74 on the interior base compartment 62 also mate with each of the lid locking members on the lid 14.

It should also be understood that tear away band 16 may be formed with a different color in order to distinguish it from the rest of the container.

Further, it should be understood that package 10 may be used to hold consumer products instead of food products.

Further, it should be understood that package 10 may be sealed by known welding techniques for sealing the tray and the lid together, by ultrasonic welding, RF welding, or heat sealing.

Advantages of Present Invention

Accordingly, the present invention provides the advantage of a tamper evident food container having an integrally formed tear away band at the periphery of the re-closeable lid to separate the lid from the tray.

A further advantage provided by the present invention is a tamper evident food container which is re-closeable, and is easy for people to use intuitively without instructions.

A further advantage provided by the present invention is a tamper evident food container and lid that can be mass-produced in an automated and economical manner and is readily affordable by the consumer.

A latitude of modification, change and substitution are intended in the foregoing disclosure, and in some instances, some features of the invention will be employed without a corresponding use of other features. Accordingly, it is appropriate that the appended claims are construed broadly and in a manner consistent with the spirit and scope of the invention herein.

The invention claimed is:

1. A tamper-evident container, comprising:

a base tray having a bottom and a sidewall forming an interior volume, the base tray further comprising an edge extending peripherally outward from an upper edge of the sidewall; and a lid having an edge extending peripherally outward therefrom, the lid edge being configured to mate with the tray edge to close the container, the lid edge having an inner portion and an outer portion, the inner and outer portions having a perforated section therebetween, the perforated section extending continuously around the entire periphery of the lid such that no portion of the lid can be separated from the tray without separating at least a part of the outer portion from the inner portion along the perforated section, whereby the outer portion forms a tamper-evident seal removable from the inner portion for removing the lid from the tray, wherein the peripherally extending edge of the tray is disposed beneath the outer portion of the lid edge and extends peripherally outward to or beyond a free end of the outer portion of the lid edge to protect the tamper-evident seal.

2. A tamper-evident container formed by thermoforming, the container comprising, a base tray having a bottom and a sidewall forming an interior volume, the base tray further comprising an edge extending peripherally outward from an upper edge of the sidewall; and a lid having an edge extending peripherally outward therefrom, the lid edge being configured to mate with the tray edge to close the container, the lid edge having an inner portion and an outer portion, the inner and outer portions having a perforated section therebetween, the perforated section extending continuously around the entire periphery of the lid such that no portion of the lid can be separated from the tray without separating at least a part of the outer portion from the inner portion along the perforated section, whereby the outer portion forms a tamper-evident seal removable from the inner portion for removing the lid from the tray, wherein before the outer portion of the lid edge is removed, the lid edge is matable with the tray edge to secure the lid to the tray without applying heat or adhesive.

3. The tamper-evident container of claim 1, wherein after the outer portion of the lid edge is removed, the inner portion of the lid edge is configured for a snap fit with the peripherally extending edge of the tray for removably securing the lid to the tray.

4. The tamper-evident container of claim 1, wherein the inner portion of the lid edge comprises a tab having an edge that is exposed when the tamper-evident seal is removed.

5. The tamper-evident container of claim 1, wherein the lid is formed by a thermoforming process.

6. The tamper-evident container of claim 1, wherein the base tray is formed by a thermoforming process.

7. The tamper-evident container of claim 1, wherein the lid is formed of any of the following plastic materials: high density polyethylene (HDPE), polyethylene terephthalate (PET), polypropylene (PP), polystyrene (PS), and polylactic acid (PLA).

8. The tamper-evident container of claim 1, wherein the peripherally extending edge of the tray and the peripherally extending edge of the lid each has a corresponding peripheral channel configured so that one of said peripheral channels is received in the other of said peripheral channels for securing the lid to the tray.

9. The tamper-evident container of claim 8, wherein each of said peripheral channels comprises an inner wall and an outer wall joined by a channel wall, each of said channel walls being oriented substantially parallel to a peripheral plane of the tray edge and the lid edge.

10. The tamper-evident container of claim 9, wherein the perforated section of the lid edge is formed in the channel wall of the lid edge.

11. The tamper-evident container of claim 9, wherein the inner walls of said peripheral channels each forms an acute angle with its corresponding channel wall to create a snap fit between said peripheral channels when the lid is secured to the tray.

12. The tamper-evident container of claim 9, wherein the inner and outer walls of said peripheral channels each forms an acute angle with its corresponding channel wall to create a snap fit between said peripheral channels when the lid is secured to the tray.

13. The tamper-evident container of claim 12, wherein the inner walls of the peripheral channels each forms a smaller acute angle with its corresponding channel wall than the acute angle formed between each outer wall and its corresponding channel wall.

14. The tamper-evident container of claim 1, wherein the outer portion of the lid edge is in contact with the peripherally extending edge of the tray around the entire periphery of the tray.

15. The tamper-evident container of claim 2, wherein after the outer portion of the lid edge is removed, the inner portion of the lid edge is configured for a snap fit with the peripherally extending edge of the tray for removably securing the lid to the tray.

16. The tamper-evident container of claim 2, wherein the peripherally extending edge of the tray and the peripherally extending edge of the lid each has a corresponding peripheral channel configured so that one of said peripheral channels is received in the other of said peripheral channels for securing the lid to the tray.

17. The tamper-evident container of claim 16, wherein each of said peripheral channels comprises an inner wall and an outer wall joined by a channel wall, each of said channel walls being oriented substantially parallel to a peripheral plane of the tray edge and the lid edge.

18. The tamper-evident container of claim 17, wherein the perforated section of the lid edge is formed in the channel wall of the lid edge.

19. The tamper-evident container of claim 17, wherein the inner walls of said peripheral channels each forms an acute angle with its corresponding channel wall to create a snap fit between said peripheral channels when the lid is secured to the tray.

20. The tamper-evident container of claim 17, wherein the inner and outer walls of said peripheral channels each forms an acute angle with its corresponding channel wall to create a snap fit between said peripheral channels when the lid is secured to the tray.

21. The tamper-evident container of claim 20, wherein the inner walls of the peripheral channels each forms a smaller acute angle with its corresponding channel wall than the acute angle formed between each outer wall and its corresponding channel wall.

* * * * *